US007100336B2

(12) United States Patent
Messenger et al.

(10) Patent No.: US 7,100,336 B2
(45) Date of Patent: Sep. 5, 2006

(54) CONCRETE BUILDING PANEL WITH A LOW DENSITY CORE AND CARBON FIBER AND STEEL REINFORCEMENT

(75) Inventors: Harold G. Messenger, Rehoboth, MA (US); Thomas G. Harmon, St. Louis, MO (US); Kenneth Baur, Mohnton, PA (US); Gary C. Graziano, Lititz, PA (US); Harry Gleich, Greenville, SC (US)

(73) Assignee: Oldcastle Precast, Inc., Rehoboth, MA (US)

( * ) Notice: Subject to any disclaimer, the term of this patent is extended or adjusted under 35 U.S.C. 154(b) by 388 days.

(21) Appl. No.: 10/772,148

(22) Filed: Feb. 3, 2004

(65) Prior Publication Data

US 2004/0206032 A1 Oct. 21, 2004

Related U.S. Application Data

(63) Continuation-in-part of application No. 10/423,286, filed on Apr. 24, 2003, now Pat. No. 6,898,908, which is a continuation-in-part of application No. 10/150,465, filed on May 17, 2002, now Pat. No. 6,729,090, which is a continuation-in-part of application No. 10/093,292, filed on Mar. 6, 2002, now Pat. No. 6,701,683.

(51) Int. Cl.

| | |
|---|---|
| ***E04C 2/00*** | (2006.01) |
| ***E04C 2/26*** | (2006.01) |
| ***E04C 1/40*** | (2006.01) |
| ***E04C 1/00*** | (2006.01) |

(52) U.S. Cl. ..... 52/309.17; 52/309.16; 52/309.11; 52/309.12; 52/794.1; 52/745.15; 52/747.1; 52/742.14; 428/158; 428/159; 428/160

(58) Field of Classification Search ..... 52/309.16, 52/309.17, 309.11, 309.12, 794.1, 745.15, 52/747.1, 742.14; 428/158, 159, 160
See application file for complete search history.

(56) References Cited

U.S. PATENT DOCUMENTS

| | | | | |
|---|---|---|---|---|
| 890,011 | A | 6/1908 | Anderson | 52/602 |
| 1,229,904 | A | 6/1917 | Day | 52/602 |
| 1,420,246 | A | 6/1922 | Faber | 52/602 |
| 1,484,206 | A | 2/1924 | Birkholz | 52/602 |
| 1,834,892 | A | 12/1931 | Betzler | 52/602 |
| 1,891,837 | A | 12/1932 | Pittman | 52/602 |
| 1,897,327 | A | 2/1933 | Olson | 52/602 |
| 2,080,618 | A | 5/1937 | Madsen | 52/602 |
| 2,312,293 | A | 2/1943 | Weiss | 52/600 |
| 3,298,152 | A | 1/1967 | Lockshaw | |
| 3,305,991 | A | 2/1967 | Weismann | |
| 3,567,816 | A | 3/1971 | Embree | 52/602 |
| 3,597,890 | A | 8/1971 | Hala | 52/309 |
| 3,646,715 | A | 3/1972 | Pope | |
| 3,775,916 | A | 12/1973 | Bair | |

(Continued)

FOREIGN PATENT DOCUMENTS

| | | | | |
|---|---|---|---|---|
| AU | 114294 | 12/1941 | | 52/602 |

(Continued)

*Primary Examiner*—Robert Canfield
*Assistant Examiner*—Abdul Manaf
(74) *Attorney, Agent, or Firm*—Sheridon Ross P.C.

(57) ABSTRACT

An insulative, lightweight building panel is provided with a lightweight, insulative foam core and which includes one or more carbon fiber or steel reinforcements and an exterior concrete face which are manufactured in a controlled environment and can be easily transported and erected at a building site.

30 Claims, 25 Drawing Sheets

Wall Panel Section . . .

U.S. PATENT DOCUMENTS

| | | | | | |
|---|---|---|---|---|---|
| 3,879,908 | A | | 4/1975 | Weismann | |
| 4,019,297 | A | | 4/1977 | Murphy | 52/309 |
| 4,052,825 | A | | 10/1977 | Larsson | |
| 4,073,998 | A | | 2/1978 | O'Connor | 428/310 |
| 4,104,842 | A | | 8/1978 | Rockstead et al. | |
| 4,125,981 | A | | 11/1978 | MacLeod et al. | |
| 4,229,497 | A | | 10/1980 | Piazza | 52/309 |
| 4,233,787 | A | | 11/1980 | Piazza | 52/602 |
| 4,505,019 | A | | 3/1985 | Deinzer | |
| 4,572,857 | A | * | 2/1986 | Bekaert | 428/117 |
| 4,611,450 | A | * | 9/1986 | Chen | 52/309.4 |
| 4,612,748 | A | | 9/1986 | Arnold et al. | 52/600 |
| 4,617,219 | A | | 10/1986 | Schupack | 52/782 |
| 4,706,430 | A | | 11/1987 | Sugita et al. | |
| 4,811,770 | A | * | 3/1989 | Rapp | 52/309.12 |
| 4,832,308 | A | * | 5/1989 | Slonimsky et al. | 249/78 |
| 4,841,702 | A | | 6/1989 | Huettemann | 52/309 |
| 4,912,902 | A | | 4/1990 | Weaver | |
| 4,916,004 | A | | 4/1990 | Ensminger et al. | 428/192 |
| 4,934,121 | A | | 6/1990 | Zimmerman | 52/602 |
| 4,990,390 | A | | 2/1991 | Kawasaki et al. | |
| 5,020,287 | A | * | 6/1991 | Woods | 52/80.2 |
| 5,025,605 | A | | 6/1991 | Sekijima et al. | |
| 5,032,340 | A | | 7/1991 | Akihama et al. | 264/258 |
| 5,058,345 | A | | 10/1991 | Martinez | |
| 5,095,674 | A | | 3/1992 | Huettemann | 52/309 |
| 5,129,203 | A | | 7/1992 | Romero | 52/309.11 |
| 5,146,721 | A | * | 9/1992 | Candiracci | 52/144 |
| 5,317,848 | A | | 6/1994 | Abbey | 52/630 |
| 5,398,470 | A | | 3/1995 | Ritter et al. | |
| 5,493,836 | A | | 2/1996 | Lopez-Munoz | 52/602 |
| 5,493,838 | A | | 2/1996 | Ross | 52/745 |
| 5,758,463 | A | | 6/1998 | Mancini, Jr. | 52/309 |
| 5,836,715 | A | | 11/1998 | Hendrix et al. | 404/134 |
| D406,902 | S | | 3/1999 | Lockwood | D25/1 |
| 5,894,003 | A | | 4/1999 | Lockwood | 264/36 |
| 6,000,194 | A | * | 12/1999 | Nakamura | 52/783.17 |
| D426,321 | S | | 6/2000 | Lockwood | D25/138 |
| 6,088,985 | A | | 7/2000 | Clark | 52/309 |
| 6,094,881 | A | | 8/2000 | Lockwood | 52/731 |
| 6,131,365 | A | * | 10/2000 | Crockett | 52/794.1 |
| 6,164,035 | A | | 12/2000 | Roberts | 52/563 |
| 6,202,375 | B1 | * | 3/2001 | Kleinschmidt | 52/309.11 |
| 6,230,465 | B1 | | 5/2001 | Messenger et al. | 52/630 |
| 6,237,297 | B1 | | 5/2001 | Paroly | |
| 6,263,629 | B1 | | 7/2001 | Brown | |
| 6,272,805 | B1 | * | 8/2001 | Ritter et al. | 52/309.11 |
| 6,295,786 | B1 | * | 10/2001 | Lee | 52/745.19 |
| 6,345,483 | B1 | | 2/2002 | Clark | |
| 6,434,900 | B1 | * | 8/2002 | Masters | 52/283 |
| 6,631,603 | B1 | * | 10/2003 | Zornes | 52/782.1 |
| 6,701,683 | B1 | | 3/2004 | Messenger et al. | 52/309.11 |
| 6,718,712 | B1 | * | 4/2004 | Heath | 52/309.12 |
| 2001/0010140 | A1 | | 8/2001 | Ritter et al. | |
| 2002/0189182 | A1 | | 12/2002 | Record | |
| 2003/0029107 | A1 | | 2/2003 | Ritter et al. | |
| 2004/0016194 | A1 | * | 1/2004 | Stefanutti et al. | 52/425 |

FOREIGN PATENT DOCUMENTS

| | | | |
|---|---|---|---|
| EP | 16478 | 10/1980 | 52/602 |
| EP | 0 227 207 | 1/1987 | |
| GB | 545526 | 6/1942 | 52/602 |
| GB | 2201175 | 8/1988 | 52/630 |

* cited by examiner

Architectural Panel Center Section . . .

Architectural Panel End Section . . .

Architectural Panel End Return Section . . .

Architectural Panel Window Return Section...

Architectural Panel Bottom Section...

Architectural Panel Bottom Section . . .

Wall Panel Section . . .

Architectural Panel @ 3-Sided Rib Mid

Architectural Panel @ 4-Sided Mid Rib

Architectural Panel @ Thermally Broken Closed-End Rib Joint

Architectural Panel @ Rib

Hardwall Panel @ Joint

Hardwall Panel @ Horizontal Joint

Load-Bearing Wall Panel

Multi-unit Residential Wall Panel @ Middle Rib

Multi-unit Residential Panel @ End Rib

Multi-unit Residential Panel @ Corner Ribs

Multi-unit Residential Panel @ Bottom Rib

CONCRETE BUILDING PANEL WITH A LOW DENSITY CORE AND CARBON FIBER AND STEEL REINFORCEMENT

This application is a continuation-in-part of U.S. patent application Ser. No. 10/423,286, filed Apr. 24, 2003 now U.S. Pat. No. 6,898,908, which is a continuation-in-part of U.S. patent application Ser. No. 10/150,465 filed May 17, 2002 now U.S. Pat. No. 6,729,090, which is a continuation-in-part of U.S. patent application Ser. No. 10/093,292, filed Mar. 6, 2002 now U.S. Pat. No. 6,701,683, each of the applications or issued patents being incorporated herein in their entirety by reference.

FIELD OF THE INVENTION

The present invention relates to building components, and more specifically composite lightweight building panels which can be selectively interconnected to fabricate structures such as modular buildings, load bearing with wall panels, or applied as cladding to building frames.

BACKGROUND OF THE INVENTION

Due to the high cost of traditional concrete components and the extensive transportation and labor costs associated therein, there is a significant need in the construction industry to provide a lightweight, precast, composite building panel which may be transported to a building site and assembled to provide a structure with superior strength and insulative properties. Previous attempts to provide these types of materials have failed due to the extensive transportation costs, low insulative values and thermal conductivity associated with prefabricated concrete wire reinforced products. Further, due to the brittle nature of concrete, many of these types of building panels become cracked and damaged during transportation.

More specifically, the relatively large weight per square foot of previous building panels has resulted in high expenses arising not only from the amount of materials needed for fabrication, but also the cost of transporting and erecting the modules. Module weight also placed effective limits on the height of structures, such as stacked modules, e.g. due to limitations on the total weight carried by the foundations, footings and lowermost modules. Furthermore, there is substantial fabrication labor expense that can arise from efforts needed to design reinforcement, and the materials and labor costs involved in providing and placing reinforcement materials. Accordingly, it would be useful to provide a system for modular construction which is relatively light, can be readily stacked to heights greater than in previous configurations and, preferably, inexpensive to design and manufacture.

Further, in many situations panels or modules are situated in locations where it is desirable to have openings therethrough to accommodate doorways, windows, cables, pipes and the like. In some previous approaches, panels were required to be specially designed and cast so as to include any necessary openings, requiring careful planning and design and increasing costs due to the special, non-standard configuration of such panels. In other approaches, panels were cast without such openings and the openings were formed after casting, e.g. by sawing or similar procedures. Such post-casting procedures as cutting, particularly through the thick and/or steel-reinforced panels as described above, is a relatively labor-intensive and expensive process. In many processes for creating openings, there was a relatively high potential for cracking or splitting of a panel or module. Accordingly, it would be useful to provide panels and modules which can be post-fitted with openings such as doors and windows in desired locations and with a reduced potential for cracking or splitting.

One further problem associated with metallic wire materials used in conjunction with concrete is the varying rates of expansion and contraction. Thus with extreme heating and cooling the metallic wire tends to separate from the concrete, thus creating cracks, exposure to moisture and the eventual degradation of both the concrete and wire reinforcement due to corrosion.

One example of a composite building panel which attempts to resolve these problems with modular panel construction is described in U.S. Pat. No. 6,202,375 to Kleinschmidt (the '375 patent). In this invention, a building system is provided which utilizes an insulative core with an interior and exterior sheet of concrete and which is held together with a metallic wire mesh positioned on both sides of an insulative core. The wire mesh is embedded in concrete, and held together by a plurality of metallic wires extending through said insulative core at a right angle to the longitudinal plane of the insulative core and concrete panels. Although providing an advantage over homogenous concrete panels, the composite panel disclosed in the '375 patent does not provide the necessary strength and flexure properties required during transportation and high wind applications. Further, the metallic wire mesh materials are susceptible to corrosion when exposed to water during fabrication, and have poor insulative qualities due to the high heat transfer qualities of metallic wire. Thus, the panels disclosed in the '375 patent may eventually fail when various stresses are applied to the building panel during transportation, assembly or subsequent use. Furthermore, these panels have poor insulative qualities in cold climates due to the high heat transfer associated with the metallic wires.

Other attempts have been made to use improved building materials that incorporate carbon fiber. One example is described in U.S. Pat. No. 6,230,465 to Messenger, et al. which utilizes carbon fiber in combination with a steel reinforced precast frame with concrete. Unfortunately, the insulative properties are relatively poor due to the physical nature of the concrete and steel, as well as the excessive weight and inherent problems associated with transportation, stacking, etc. Further, previously known prefabricated building panels have not been found to have sufficient tensile and compressive strength when utilizing only concrete and insulative foam materials or wire mesh. Thus, there is a significant need for a lightweight concrete building panel which has increased tensile and compressive strength, and which utilizes one or more commonly known building materials to achieve this purpose.

Accordingly, there is a significant need in the construction and building industry to provide a composite building panel which may be used in modular construction and which is lightweight, provides superior strength and has high insulative values. Further, a method of making these types of building panels is needed which is inexpensive, utilizes commonly known manufacturing equipment, and which can be used to mass produce building panels for use in the modular construction of warehouses, low cost permanent housing, hotels, and other buildings.

SUMMARY OF THE INVENTION

It is thus one aspect of the present invention to provide a composite wall panel which has superior strength, high insulating properties, is lightweight for transportation and stacking purposes and is cost effective to manufacture. Thus, in one embodiment of the present invention, a substantially planar insulative core with interior and exterior surfaces is positioned between concrete panels which are reinforced with carbon fiber grids positioned substantially adjacent to the insulative core and which is interconnected to a plurality of diagonal carbon fiber strands. In a preferred embodiment of the present invention, the interior layer of concrete is comprised of a low-density concrete. Furthermore, as used herein, insulative core may comprise any type of material which is thermally efficient and has a low heat transfer coefficient. These materials may include, but are not limited to, Styrofoam®-type materials such as expanded polystyrenes, extruded polystyrenes, extruded polypropylene, polyisocyanurate, combinations therein and other materials, including wood materials, rubbers, and other materials well known in the construction industry.

It is yet another aspect of the present invention to provide a superior strength composite wall panel which utilizes carbon fiber materials which are oriented in a novel geometric configuration which interconnects the insulative core and both the interior and exterior concrete panels. In one embodiment of the present invention, a plurality of carbon fibers are oriented in a substantially diagonal orientation through the insulative core and which may be operably interconnected to carbon fiber mesh grids positioned proximate to the interior and exterior surfaces of the insulative core and which operably interconnect both the interior and exterior concrete panels to the insulative core. Preferably, the carbon fiber mesh grid is comprised of a plurality of first carbon fiber strands extending in a first direction which are operably interconnected to a plurality of second carbon fiber strands oriented in a second direction. Preferably, the carbon fiber mesh grids are embedded within the interior and exterior concrete panels.

It is a further aspect of the present invention to provide a lightweight, composite concrete building panel which is adapted to be selectively interconnected to a structural steel frame. Thus, in one embodiment of the present invention attachment hardware is selectively positioned within the building panel during fabrication which is used to quickly and efficiently interconnect the panel to a structural frame.

It is another aspect of the present invention to provide a low density concrete building panel which has sufficient compressive strength to allow a s second building panel to be stacked in a vertical relationship, on which can support a vertical load in the form of a floor truss or other structural member. Alternately, it is another aspect of the present invention to provide a composite lightweight building panel which can be utilized in a corner adjacent to a second building panel, or aligned horizontally with a plurality of building panels in a side by side relationship.

It is a further aspect of the present invention to provide a composite wall panel with an insulative core which has superior compressive strength than typical composite materials comprised of Styrofoam® and other similar materials. Thus, in another aspect of the present invention, a plurality of anti-compression pins are placed throughout the insulative core and which extend substantially between the interior and exterior surfaces of the insulative core. Preferably, these pins are comprised of ceramic, fiberglass, carbon-fiber or other materials which are resistant to compression and do not readily transfer heat.

It is another aspect of the present invention to provide a composite wall panel which can be easily modified to accept any number of exterior textures, surfaces or cladding materials for use in a plurality of applications. Thus, the present invention is capable of being finished with a brick surface, stucco, siding and any other type of exterior surface. In one embodiment of the present invention, a paraffin protective covering is provided on the exterior surface for protection of the exterior surface during manufacturing. The paraffin additionally prevents an excessive bond between the individual bricks and exterior concrete wall to allow the removal of a cracked or damaged brick and additionally has been found to reduce cracking in the bricks due to the differential shrinkage of the exterior concrete layer and clay brick. Furthermore, other types of materials such as drywall and other interior finishes can be applied to the interior concrete panel as necessary for any given application.

It is yet a further aspect of the present invention to provide a novel exterior cladding configuration which allows broken or cracked bricks to be quickly and effectively replaced. Thus, in one embodiment of the present invention a beveled brick design is provided wherein a rear portion of the brick has a greater diameter than a front end, and is embedded into the exterior concrete layer during the forming process. This design provides superior strength, and allows a damaged brick to be chiseled free and quickly replaced with a new brick by applying a glue or epoxy material.

It is yet another aspect of the present invention to provide a composite modular wall panel which can be used to quickly and efficiently construct modular buildings and temporary shelters and is designed to be completely functional with regard to electrical wiring and other utilities such as telephone lines, etc. Thus, the present invention in one embodiment includes at least one utility line which may be positioned at least partially within the composite wall panel and which accepts substantially any type of utility line which may be required in residential or commercial construction, and which can be quickly interconnected to exterior service lines. This utility line may be oriented in one or more directions and positioned either near the interior concrete panel, exterior concrete panel, or both.

It is yet another aspect of the present invention to provide a novel surface configuration of the insulative core which assures a preferred spacing between the surface of the insulative core and the carbon fiber grid. This surface configuration is applicable for a front surface, a rear surface, or both depending on the application. More specifically, the spacing is designed to provide a gap between the interior and/or the exterior surface of the insulative core and the carbon fiber grids to assure that concrete or other facing materials become positioned between the surface of the insulative core and the carbon fiber grid. This improved and consistent spacing enhances the strength and durability of the insulative panel when interconnected to the facing material, carbon fiber grids and transverse fibers and/or steel pre-stressing strands.

Thus, in one embodiment of the present invention the insulative core may have an interior and/or an exterior surface which is undulating, i.e., wavy alternative embodiments may have channels or protruding rails, spacer "buttons", a "waffleboard" configuration, or other shapes which create a preferred spacing between the surface of the insulative material and the fiber grids. Preferably, the spacing apparatus, channels, rails or other spacers are integrally molded with the insulative core to reduce labor and expenses. Alternatively, these spacing apparatus may be interconnected to the insulative foam after manufacturing, and may be attached with adhesives, screws, nails, staples or other interconnection means well known by one skilled in the art.

Thus, in one embodiment of the present invention, a low density, substantially planar carbon reinforced concrete building panel is provided, and which comprises:

a foam core having an inner surface, an outer surface, an upper end, a lower end, and a plurality of perimeter edges, said foam core comprising at least one cut-out portion extending substantially between at least two of said plurality of perimeter edges;

a first concrete material positioned adjacent said outer surface of said foam core;

a first carbon fiber material positioned within said first concrete material;

a second carbon fiber material positioned within said at least one cut-out portion of said foam core and extending through said foam core beyond said outer surface and in operable contact with said first carbon fiber material;

at least one first reinforcing bar positioned proximate to said at least one carbon fiber material within said cut-out portion, and extending substantially between said upper end and said lower end of said foam core; and a second concrete material positioned within said cut-out portion of said foam core, and extending substantially from said upper end to a lower end of said foam core.

It is a further aspect of the present invention to provide a lightweight, durable building panel which utilizes concrete and expanded polystyrene materials, along with a unique geometry of carbon fiber, steel reinforcing rods, and wire mesh to create a building panel with superior strength and durability. The building may utilize one or more reinforcing materials such as carbon fiber, wire mesh or steel reinforcing bars positioned along 1) a perimeter edge; 2) an interior portion within the perimeter edge; or 3) both along the perimeter edges and within a predetermined interior portion of the building panel. Thus, in another embodiment of the present invention a lightweight, durable concrete building panel is provided, comprising:

a substantially planar concrete panel comprising an inner surface, an outer surface, an upper end and a lower end, and a substantially longitudinal axis defined between said upper end and said lower end;

a first carbon fiber grid positioned within said substantially planar concrete panel between said upper end and said lower end and positioned proximate to said inner surface;

a foam core having an inner surface and an outer surface positioned within said substantially planar concrete panel and extending substantially between said upper end and said lower ends of said substantially planar concrete panel;

at least one carbon fiber shear strip extending through said foam and oriented in a substantially linear direction between said upper end and said lower ends of said substantially planar concrete panel;

at least one first reinforcing bar positioned proximate to said at least one carbon fiber shear strip, and extending substantially between said upper end and said lower end of said substantially planar concrete panel; and a wire mesh material positioned above said upper surface of said foam core and proximate to said outer surface of said substantially planar concrete panel.

In a preferred embodiment of the present invention, the insulative core is comprised of a plurality of individual insulative panels. The seam of the insulative panels preferably has a cut-out portion which is used to support reinforcing materials such as rebar, carbon fiber or other material.

It is a further aspect of the present invention to provide a method of fabricating an insulative concrete building panel in a controlled manufacturing facility which is cost effective, utilizes commonly known building materials and produces a superior product. It is a further aspect of the present invention to provide a manufacturing process which can be custom tailored to produce a building panel with custom sizes, allows modifications for windows and doors, and which utilizes a variety of commonly known materials without significantly altering the fabrication protocol.

Thus, in one aspect of the present invention, a method for fabricating a lightweight, durable concrete building panel is provided, comprising the steps of:

a) providing a form having an upper end, a lower end, and lateral edges extending therebetween;

b) positioning a first concrete material into a lower portion of said form;

c) positioning a first grid of carbon fiber material into said first layer of concrete material;

d) positioning a foam core onto said first layer of concrete material, said layer of foam core having a plurality of cut-out reinforced sections, said reinforced sections comprising a second grid of carbon fiber material extending into said first layer of concrete material and a reinforcing bar extending substantially along an entire length of said reinforced section and positioned proximate to said second grid of carbon fiber material.

e) positioning a second layer of concrete within said plurality of reinforced sections; and f) removing said lightweight, concrete building panel from said form.

DETAILED DESCRIPTION

Figure 1:
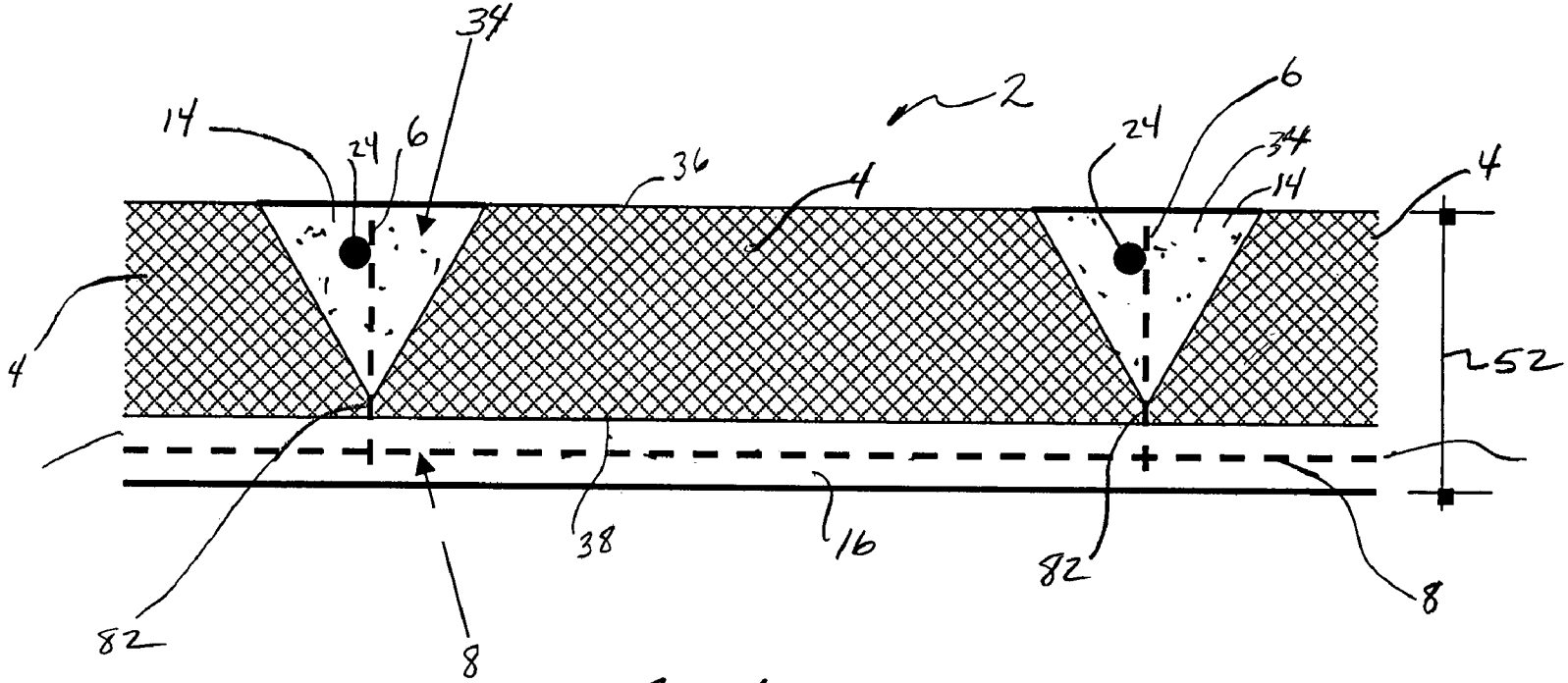
FIG. 1 is a cross-sectional top plan view of a composite building panel which represents one embodiment of the present invention.

Referring now to the drawings, FIG. 1 is a cross-sectional top plan view of one embodiment of the present invention which depicts a novel composite building panel 2. More specifically, the building panel 2 is generally comprised of an insulative core 4 which has an interior surface 36 and exterior surface 38 and a substantially longitudinal plane extending from a lower portion to an upper portion of said insulative core 4. Positioned within the insulated core 4 are one or more cut-outs 34 extending from the interior surface 36 and oriented toward an exterior surface 38. In a preferred embodiment, a thermal break 82 is provided at the apex of the cut-out and which has a dimension of at least about ½ inch and more preferably 1.0–2.0 inches and which separates the interior concrete layer 14 from the exterior concrete layer 16. The thermal break 82 provides a layer of insulation core 4, and hence improves the thermal efficiency and heat transfer characteristics of the building panel 2.

Positioned within each of the insulative core cutout portions 34 is an interior carbon fiber grid 6 which extends through the insulative core cutout 34 and is positioned adjacent to and more preferably operably connected to the exterior carbon fiber grid 8. The exterior carbon fiber grid 8 is further embedded within an exterior concrete layer 16, and which represents in one embodiment an exterior face of the composite building panel 2. As appreciated by one skilled in the art, the exterior concrete layer 16 may additionally include various types of exterior cladding 20 such as bricks, stucco, and other similar materials depending on the application. As further depicted in FIG. 1, the overall strength of the composite building panel 2 is increased by utilizing one or more reinforcing bars 24 within each of the insulative core cut-outs 34, or alternatively using prestressed cable 22. Although the total panel thickness 52 is preferably between about 6 and 10 inches, depending on the application the panel thickness may vary between about 4 and 16 inches as appreciated by one skilled in the art.

Figure 2:
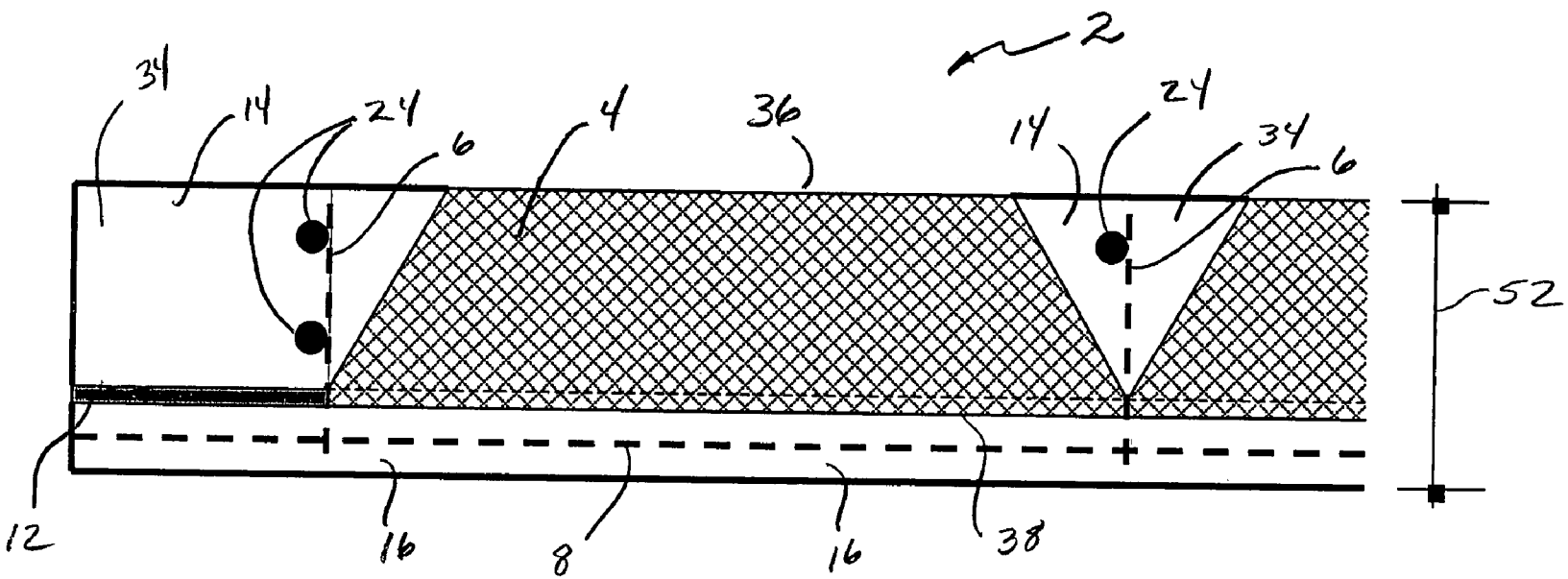
FIG. 2 is a cross-sectional top plan view of a composite building panel end section which represents one embodiment of the present invention.

Referring now to FIG. 2, a cross-sectional top plan view of a composite building panel end section is depicted herein. More specifically, the end section has components similar to the panel section shown in FIG. 1, but which has an additional insulative core cut-out portion 34 positioned near the panel end. The insulative core cut-out portion 34 further comprises a plurality of reinforcing bars 24 positioned adjacent an interior carbon fiber grid 6, and further includes an optional thermal/vapor barrier 12 which is utilized to increase the panel thermal efficiency, and thus prevent excessive heat loss. The thermal/vapor barrier 12 may be comprised of foam materials, polypropylenes, polyethylenes, rubbers, and other thermal/vapor barrier materials well known in the construction industry.

Figure 3:
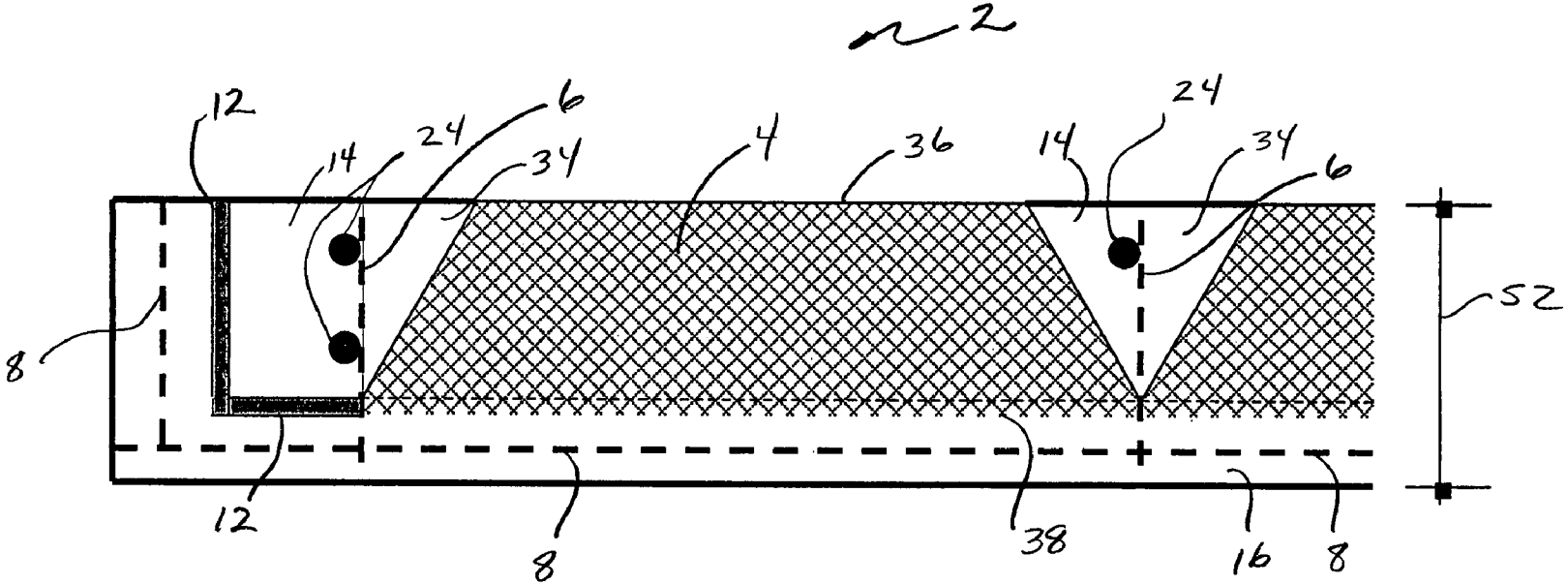
FIG. 3 is a cross-sectional top plan view of a composite building panel end return section which represents one embodiment of the present invention.

Referring now to FIG. 3, a cross-sectional top plan view of a composite building panel end return section is depicted herein. More specifically, the architectural panel end return section is designed for use on the end of a wall panel and includes an insulated cut-out portion 34 which further comprises additional thermal/vapor barrier materials 12 to further improve the heat transfer characteristics of the panel. Notwithstanding these differences, the remaining portion of the composite building panel 2 is similar to the embodiments shown in FIGS. 1 and 2, and includes an insulation core 4 with at least one interior carbon fiber grid 6 and an exterior carbon fiber grid 8, the exterior carbon fiber grid 8 being embedded in an exterior concrete layer 16.

Figure 4:
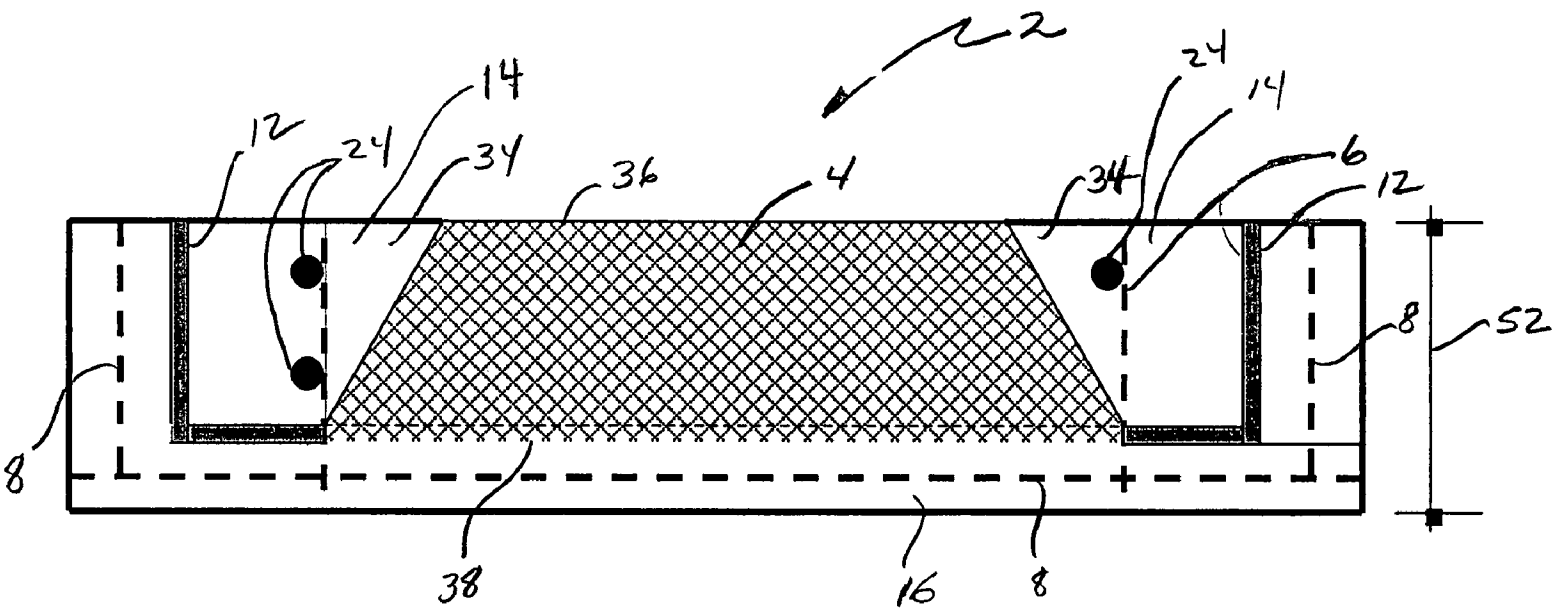
FIG. 4 is a cross-sectional top plan view of a composite building panel window return section, which represents one embodiment of the present invention.

Referring now to FIG. 4, a cross-sectional top plan view of a composite building panel window return section is provided herein. More specifically, the panel return section is used in applications adjacent to window and door openings, and which includes an interior insulative core 4 positioned between two insulative core cut-out portions 34 anc having a total diameter 52 of preferably about 6–8 inches. Each of the insulative core cut-out portions 34 are comprised of an interior carbon fiber grid 6, one or more reinforcing bars 24, and thermal/vapor barriers 12 positioned within the insulative core cutout 34 and covered with an interior concrete layer 14. The exterior face of the composite building panel 2 further comprises an exterior carbon fiber grid 8 which is embedded within the exterior concrete layer 16.

Figure 5:
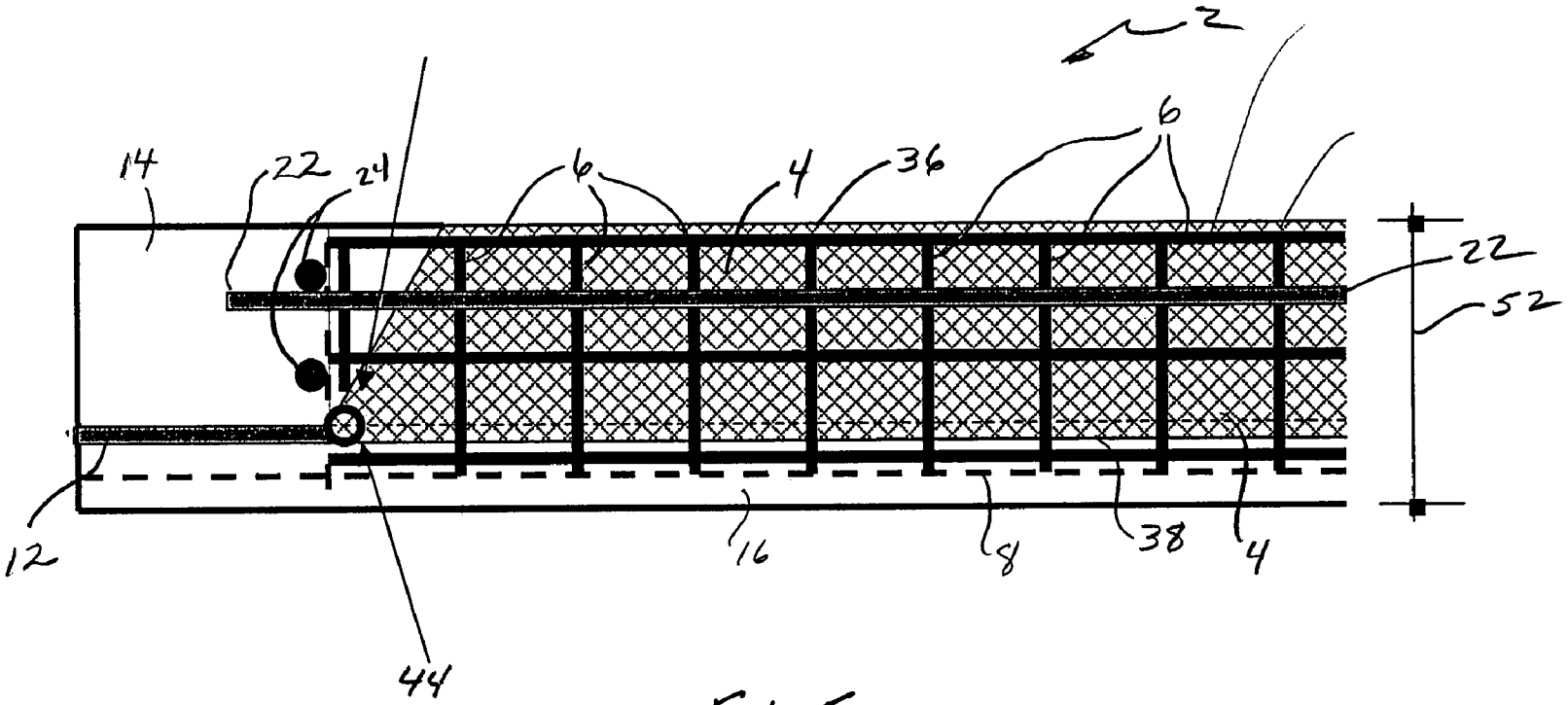
FIG. 5 is a cross-sectional top plan view of a composite building panel bottom section, which represents one embodiment of the present invention.

Referring now to FIG. 5, a cross-sectional top plan view of a composite building panel bottom section is provided herein, and which further depicts an insulative core cut-out portion 34 which is used in conjunction with an interior concrete layer 14, and an interior carbon fiber grid 6. As further depicted in FIG. 5, both reinforcing bars 24 and prestress cable 22 are used to increase the structural integrity of the building panel bottom section. Furthermore, a weep tube 44 is provided to allow drainage of any moisture which may accumulate within the architectural panel bottom section. As further shown, a thermal/vapor barrier material 12 is also utilized to improve the thermal efficiency of the building panel 2.

Figure 6:
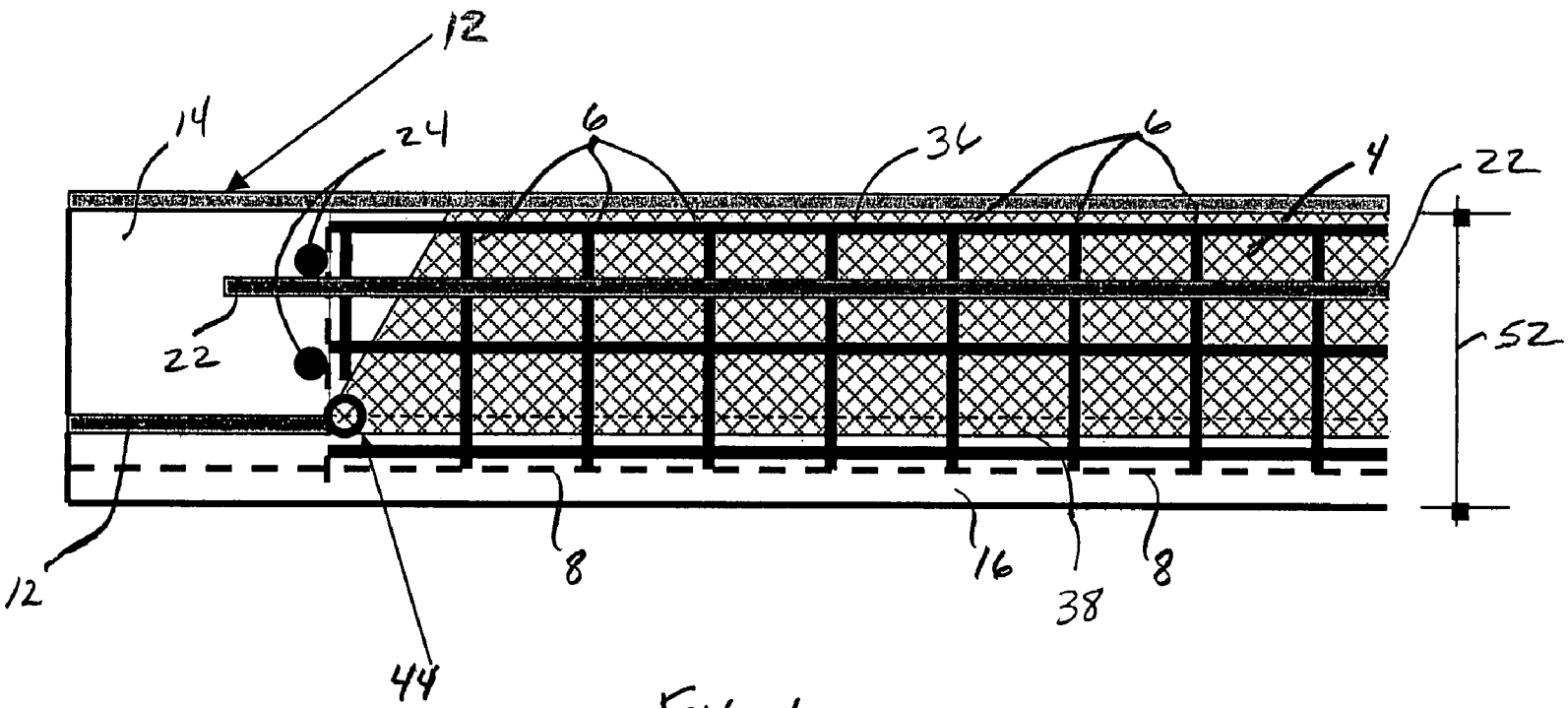
FIG. 6 is a cross-sectional top plan view of a composite building panel bottom section, which represents one embodiment of the present invention.

Referring now to FIG. 6, an alternative embodiment of the architectural panel bottom section shown in FIG. 5 is provided herein, and which generally comprises the same internal componentry with the exception of a thermal vapor barrier 12 positioned along the interior face of the architectural panel bottom section. The thermal/vapor barrier 12 as previously mentioned could be comprised of foams, plastic materials, concrete, wood, drywall or other commonly used materials which are well known in the construction industry.

Figure 7:
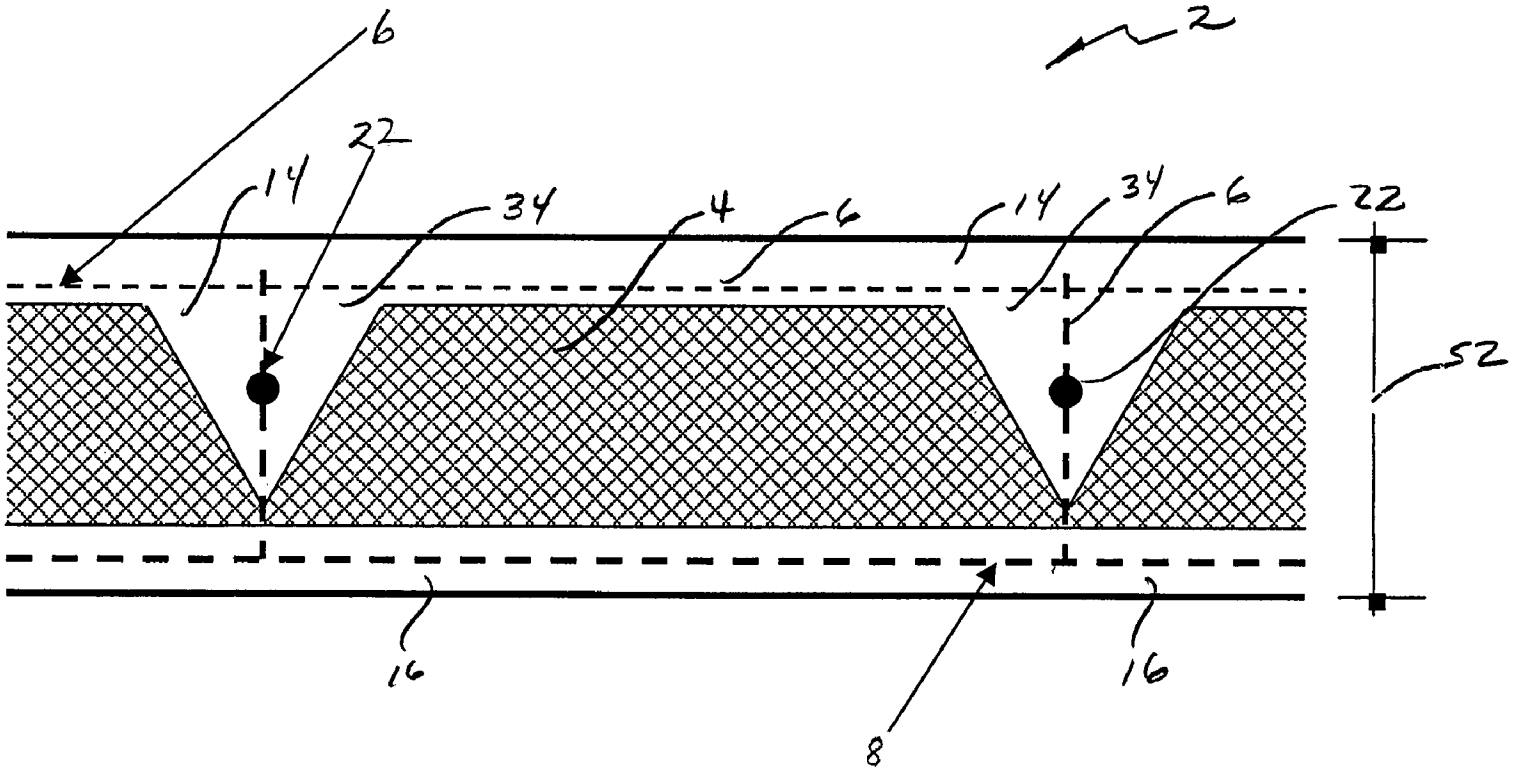
FIG. 7 is a cross-sectional top plan view of a composite building wall panel section, which represents one embodiment of the present invention.

Referring now to FIG. 7, an alternative embodiment of a wall panel section is provided herein, and more specifically comprises a wall panel composite building panel 2 which includes an additional layer of interior carbon fiber grids 6 positioned in close proximity to an interior surface, and within an interior concrete layer 14. As used herein, both the interior carbon fiber grid 6 and exterior carbon fiber grid 8 may be comprised of alternative materials such as wire mesh, fiberglass, and other construction materials to provide increased strength in structural integrity of the composite building panel. Preferably, however, the materials utilize a material known as "MeC-GRID™" which is a carbon composite comprised of a plurality of individual carbon fibers held together with an adhesive or epoxy.

Figure 8:
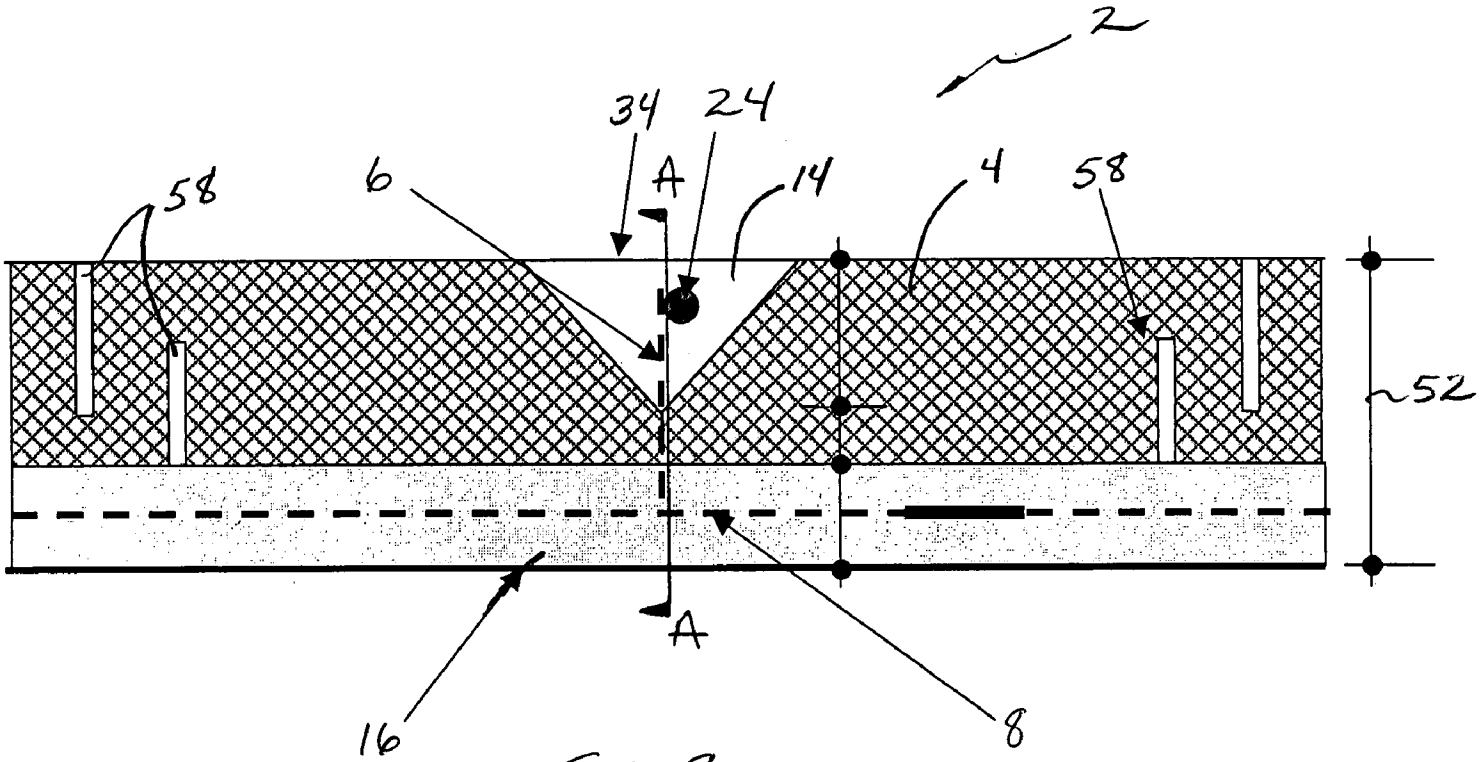
FIG. 8 is a cross-sectional top plan view of a composite architectural panel with a three-sided rib cut out portion and further including expansion joints.

Referring now to FIG. 8, a cross-sectional top plan view of a composite architectural building panel 2 of the present invention is provided herein, and which depicts a triangular shaped cut-out portion 34 which includes a interior carbon fiber grid 6, one or more reinforcing bars 24, and an interior concrete layer 14 positioned within the cut-out portion 34. Furthermore, a plurality of expansion joints 58 are provided within the insulative core 4 which are utilized to prevent excessive compression of the concrete building panel during manufacturing, transportation, and installation, and thus substantially eliminates hairline fractures of the concrete. The expansion joints are preferably cutout portions of the insulative core material 4, but other compressible materials may be positioned within the expansion joints 58 as appreciated by one skilled in the art.

Figure 9:
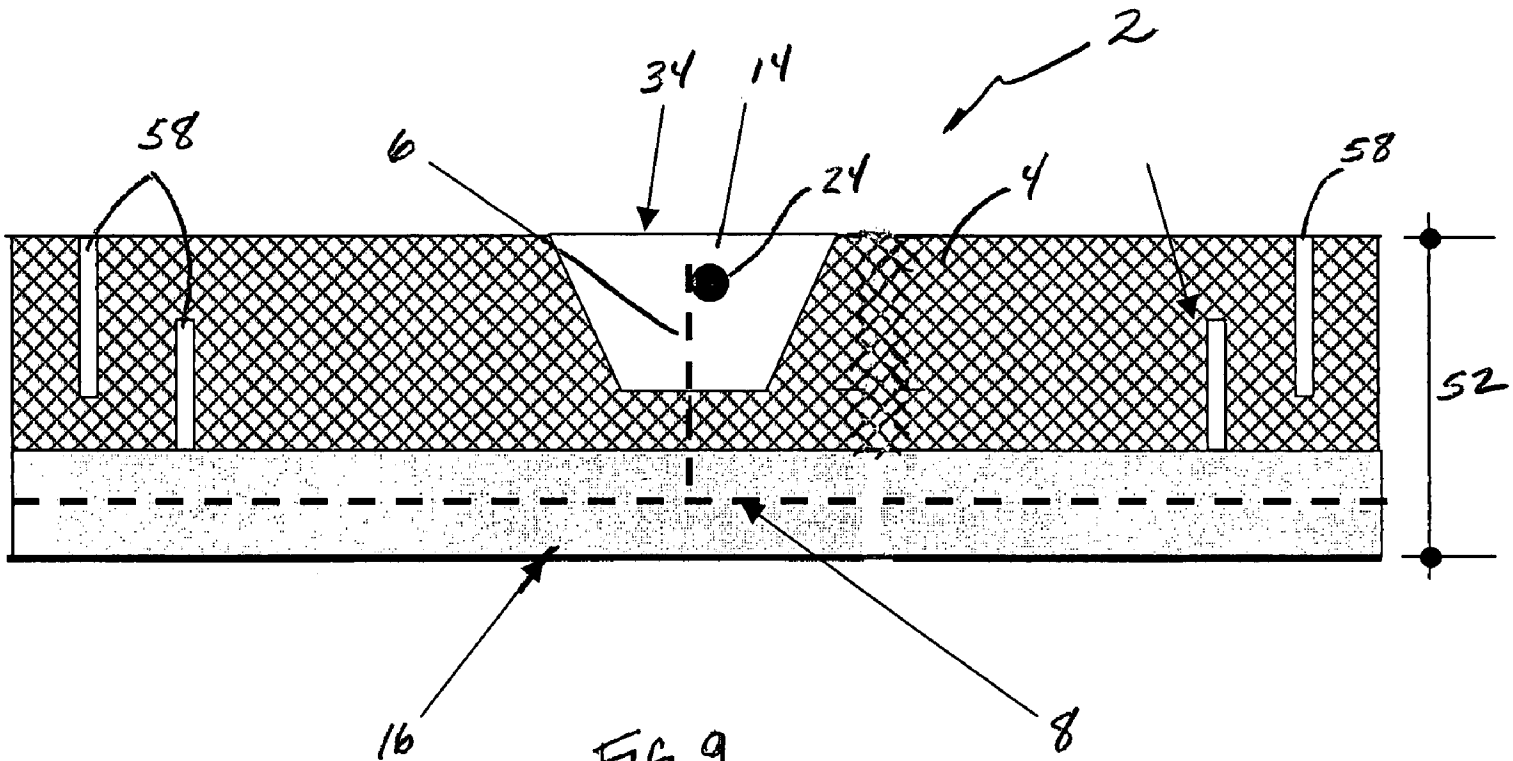
FIG. 9 is a cross-sectional top plan view of a composite architectural panel and including a four-sided mid rib cut out section.

Referring now to FIG. 9, a cross-sectional top plan view of an architectural panel with a four-sided mid rib is shown herein. More specifically, this embodiment is similar to the other architectural panels with the exception that the reinforcing rib cut-out portion 34 is four-sided as opposed to the triangular configurations shown in other embodiments. As appreciated by one skilled in the art, the cut-out portion 34 may have 9 cross-sectional geometric shapes which are triangular, rectangular, square, cylindrical, oblong or any other theoretical shape. As further depicted in FIG. 9, a plurality of expansion joints 58 are also utilized in this embodiment to help prevent cracking and the ultimate failure of the concrete materials.

Figure 10:
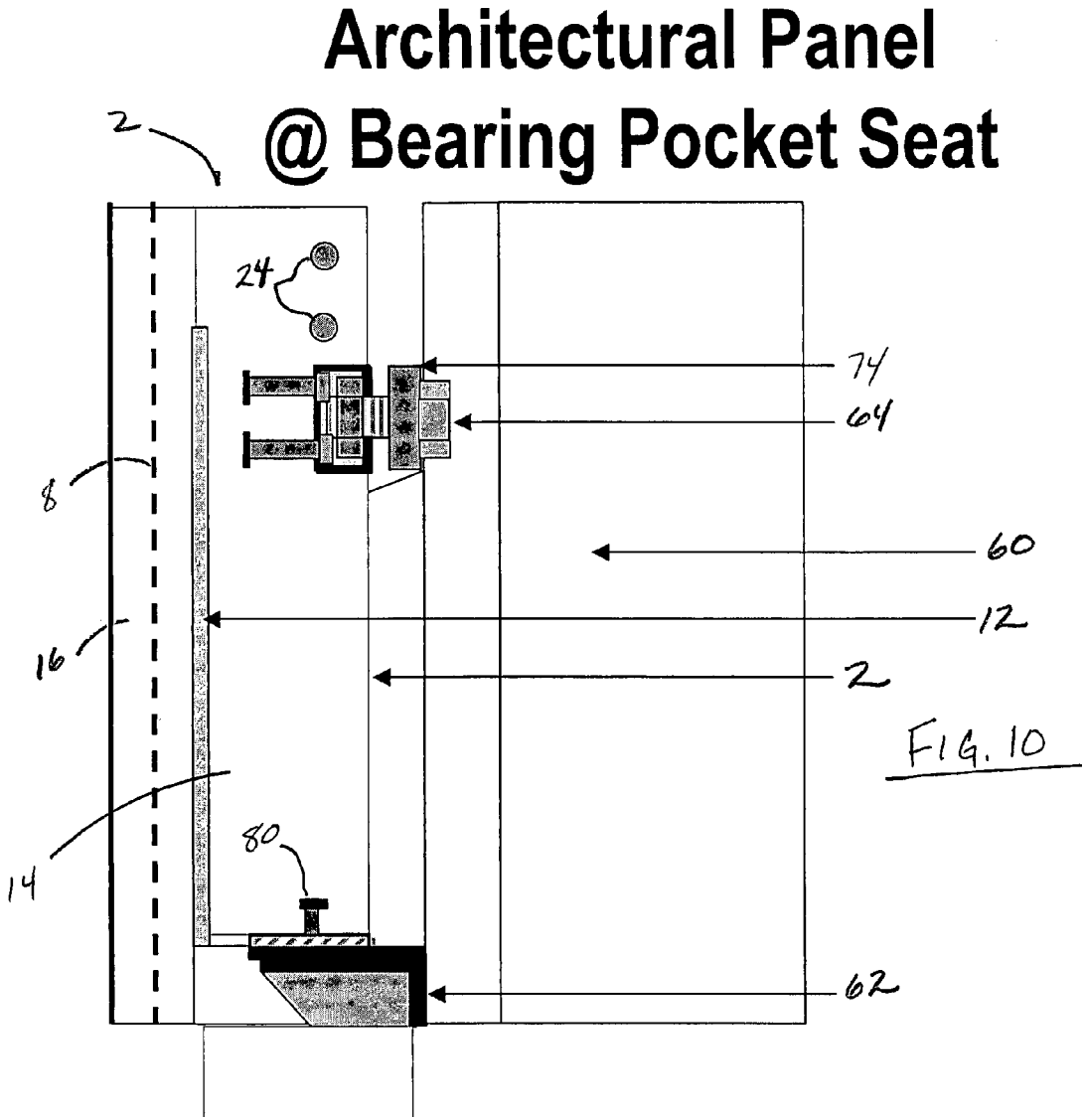
FIG. 10 is a cross-sectional front elevation view of an architectural building panel shown at a bearing pocket seat and operably interconnected to a steel girder.

Referring now to FIG. 10, an alternative embodiment of the present invention is provided herein and which depicts a cross-sectional front elevation view of a composite building panel 2 operably connected to a steel structural column 60. As provided herein, the composite building panel 2 further utilizes a thermal/vapor barrier 12, and is interconnected by the use of a slotted lateral connector hardware 64 configuration which has a plurality of bolts or other attachment hardware embedded in the interior concrete layer 14, and which is operably interconnected to the steel structural column 60. As further shown in FIG. 10, an interconnection stud 80 is embedded in the interior concrete layer 14 on a lower portion of the building panel 2, and which rests on a bearing angle with gussets 62 for vertical support. To provide horizontal adjustments between the structural column 60 and the composite building panel 2, a threaded fastener 74 may be rotated.

Figure 11:
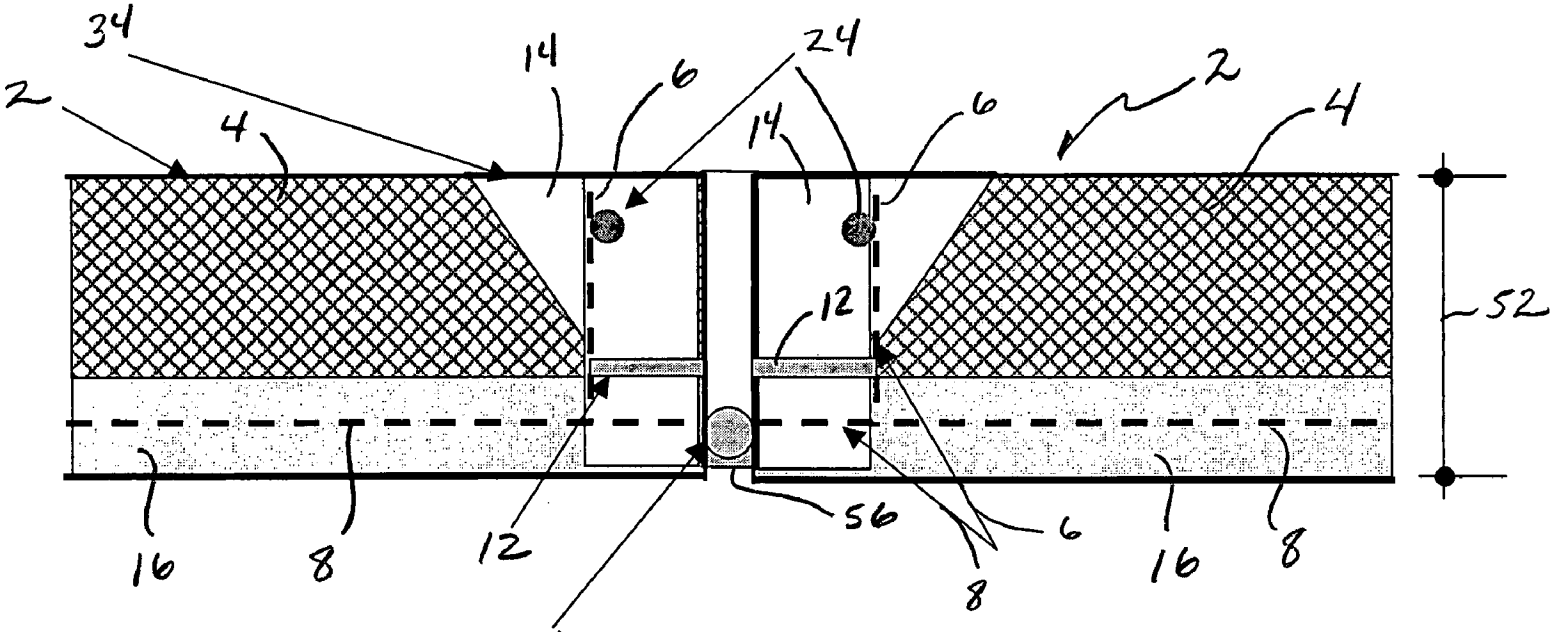
FIG. 11 is a cross-sectional top plan view of a first architectural building panel positioned adjacent a second architectural building panel, and further disclosing a thermally broken closed end rib joint.

Referring now to FIG. 11, a cross-sectional top plan view of two architectural panels positioned adjacent one another are provided herein, and which further include a thermally broken closed-end rib joint. More specifically, FIG. 11 depicts a first composite building panel 2 positioned adjacent a second composite building panel, and which includes a insulative core 4 with a insulative core cut-out portion 34 positioned substantially adjacent to one another. Each of the insulative core cut-out portions 34 may include one or more reinforcing bars 24, an interior carbon fiber grid 6, as well as a thermal vapor barrier 12. The exterior face comprises a exterior concrete layer 16 which includes an embedded exterior carbon figure grid 8. Positioned between the first composite building panel 2 and the second composite building panel is a foam rope 54 which is generally compressible and which impedes heat transfer between an interior and exterior structure of the composite building panels 2. Furthermore, a caulking material 56 may be positioned around the foam rope 54 to further improve the seal between the two building panels and improve the thermal efficiency.

Figure 12:
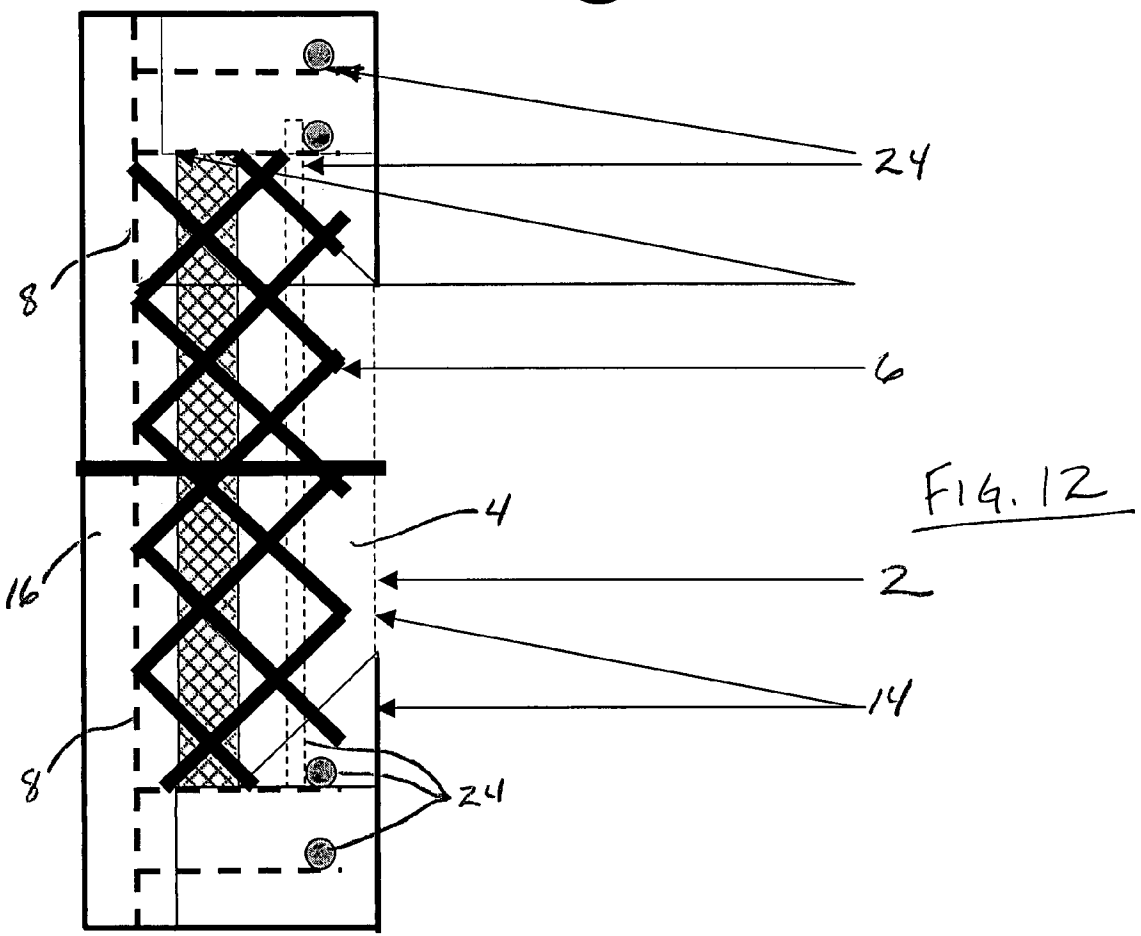
FIG. 12 is a cross-sectional elevation view taken at line AA of FIG. 9, and identifying the carbon fiber web material and other internal components of the architectural panel.

Referring now to FIG. 12, a cross-sectional front elevation view taken at line "AA" of FIG. 8 is provided herein. More specifically, the cross-sectional view identifies an architectural panel at the rib joint, and depicts the insulative core 4, the interior carbon fiber grid 6, the exterior carbon fiber grid 8, and the reinforcing bar 24 materials which are embedded within the composite building panel 2 for structural integrity. Furthermore, an interior concrete layer 14 may be positioned along an interior face of the composite building panel 2, or other materials such as wood, dry-wall, and other known construction materials.

Figure 13:
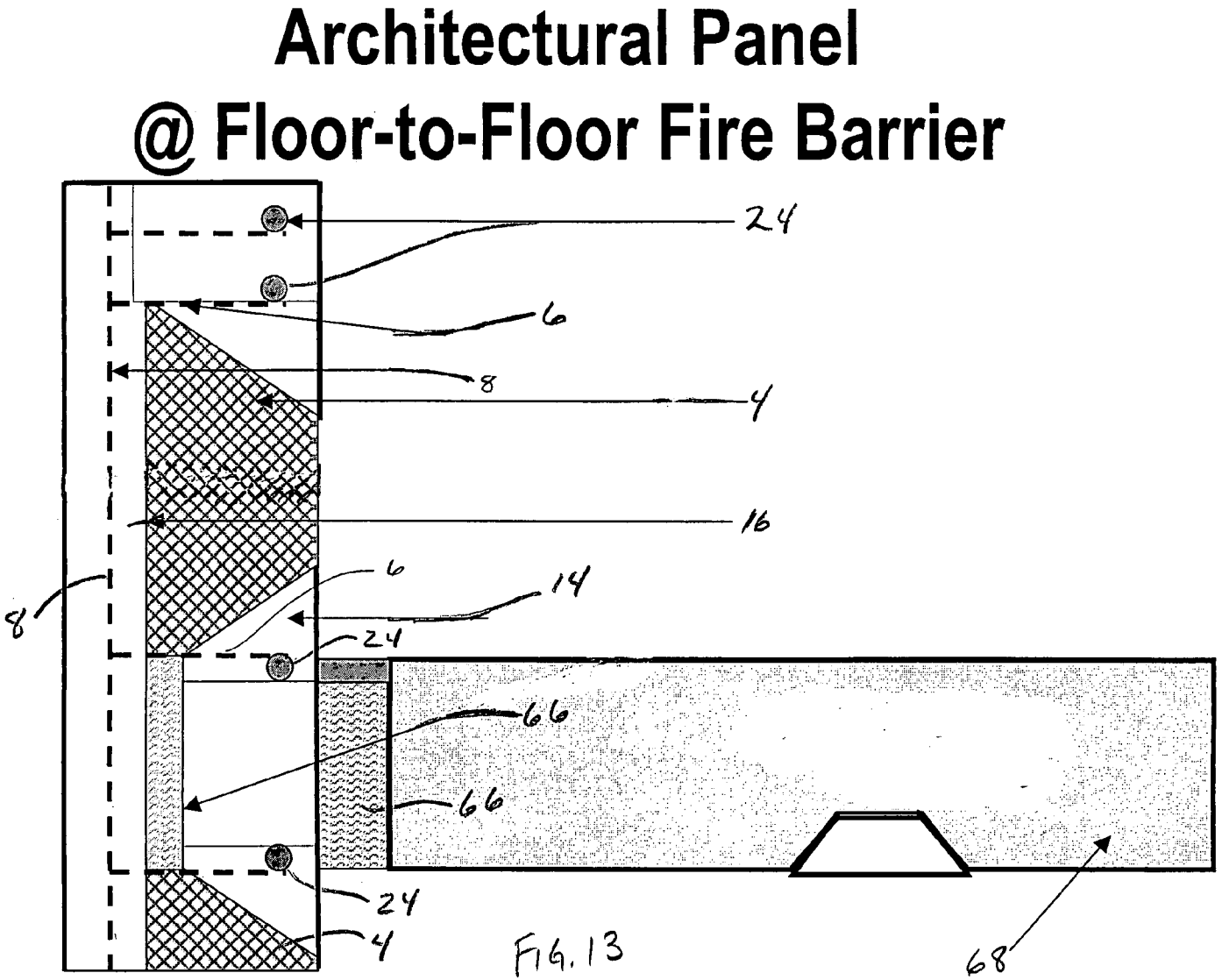
FIG. 13 is a cross-sectional front elevation view of an architectural composite building panel and depicting a floor to floor fire barrier positioned adjacent a horizontal floor section.

Referring now to FIG. 13, a cross-sectional front elevation view of an architectural composite building panel 2 which depicts a floor to floor fire barrier is provided herein. More specifically, a concrete floor slab 68 is positioned in a horizontal orientation and positioned adjacent to a vertical composite building panel 2 of the present invention. To provide a floor to floor fire barrier, a mineral wall board 66 may be provided in one or more locations in association with non interior concrete layer 14 to prevent the heat transfer between two adjacent floors in a building structure. As further depicted in FIG. 13, the insulative core cut-out 34 is shown within the insulative core 4, and further includes a plurality of interior carbon fiber grids 6, as well as an exterior carbon fiber grid 8 which is embedded in a exterior concrete layer 16. Furthermore, a plurality of reinforcing bars 24 may be provided as shown to provide additional structural integrity to the building panel 2.

Figure 14:
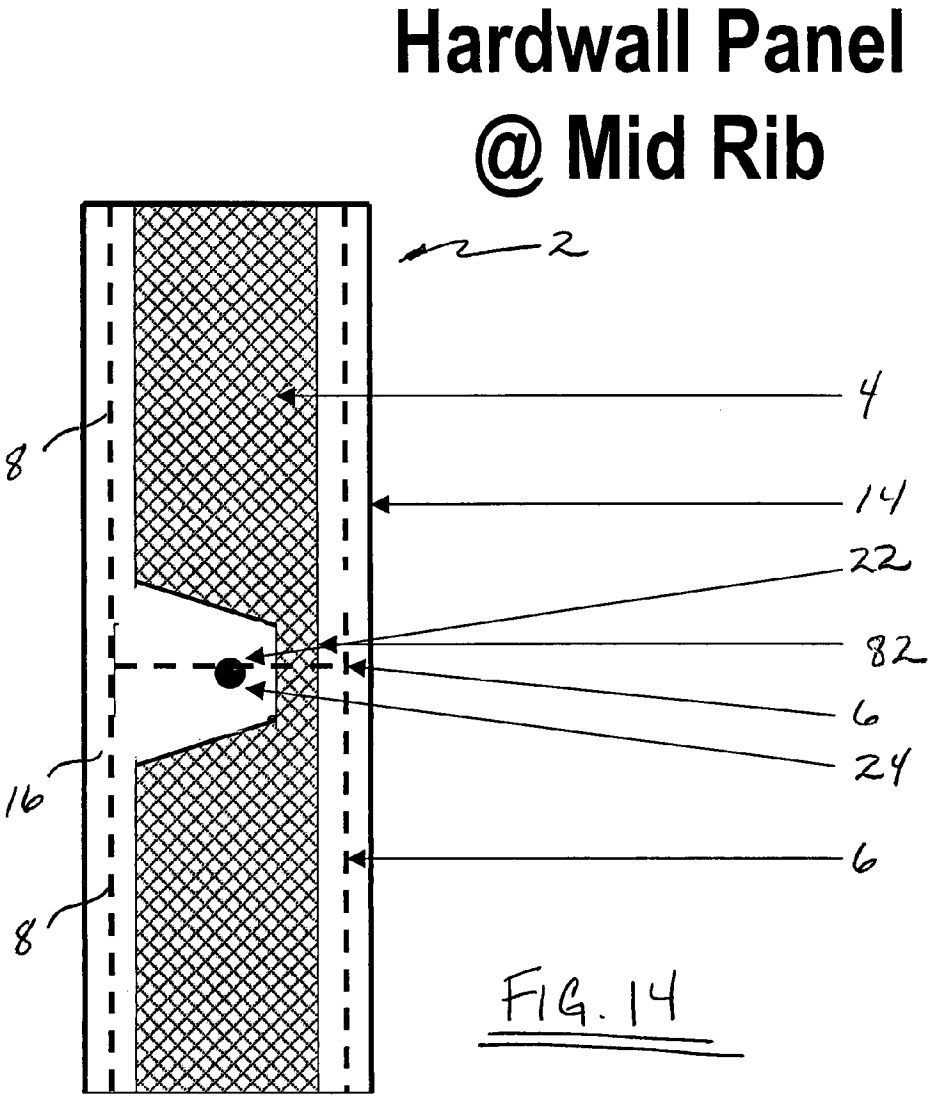
FIG. 14 is a cross-sectional front elevation view of a hardwall panel taken at amid rib section.

Referring now to FIG. 14, a cross-sectional front elevation view of a hardwall panel taken at a mid rib section is provided herein, and which generally depicts an insulative core 4 positioned between an exterior concrete layer 16, an interior concrete layer 14, and a interior carbon fiber grid 6 and exterior carbon fiber grid 8. The insulative core cut-out portion 34 further includes one or more reinforcing bars 24 or prestressed cables 22, and which also includes an interior carbon fiber grid 6 which extends substantially from the exterior concrete layer 16 to the interior concrete layer 14 for strength.

Figure 15:
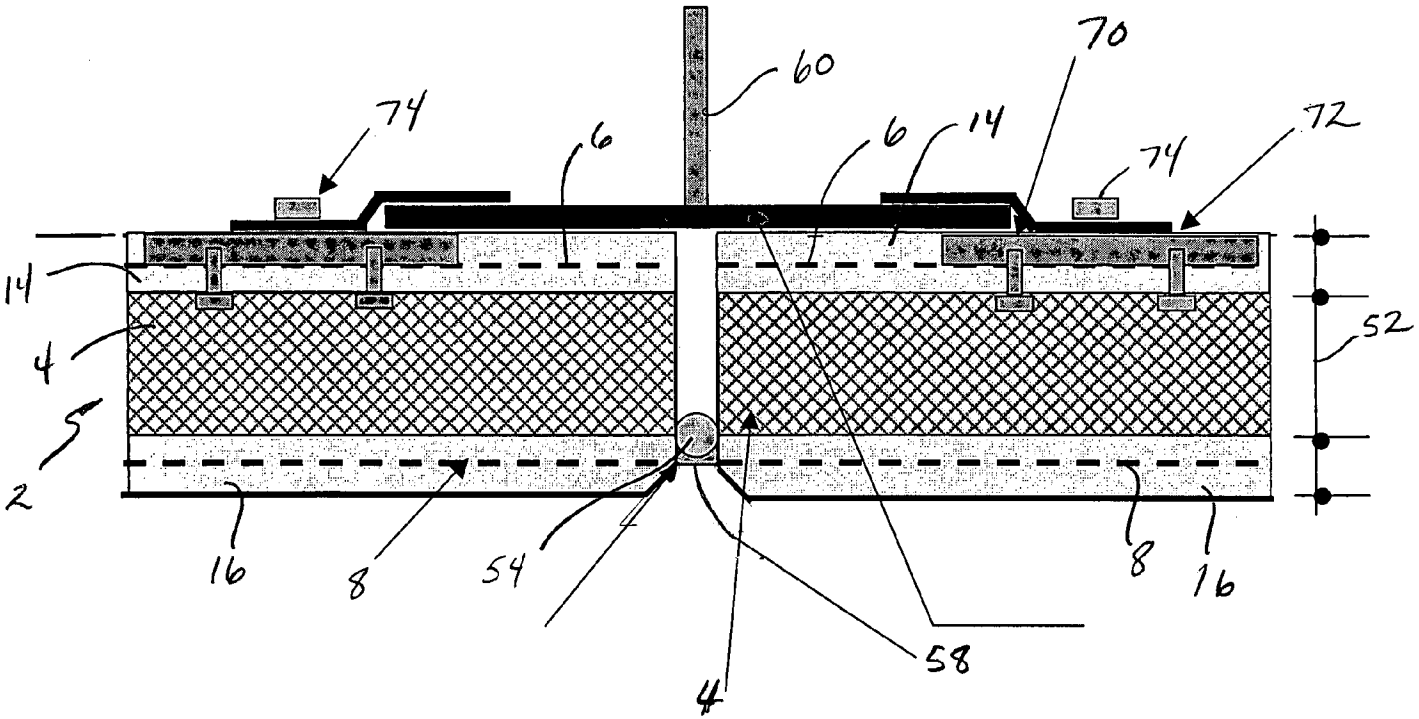
FIG. 15 is a cross-sectional top plan view of two adjoining composite building panels shown interconnected to a structural steel support member, and the associated hardware.

Referring now to FIG. 15, an alternative embodiment of the present invention is provided herein, and which depicts two composite building panels 2 operably interconnected to a steel structural column 60. More specifically, a unistrut channel with posts 70 is shown interconnected to an interior surface of each of the composite building panels 2, and are embedded into the insulative core 4 and into an interior concrete layer 14. These unistrut channels with parts 70 are further used in combination with a column clip 72 and threaded fasteners 74 to interconnect each of the composite building panels 2 to a steel structural column 60. By utilizing this type of attachment hardware, steel structural buildings may be quickly assembled utilizing the lightweight composite building panels of the present invention. As further depicted in FIG. 15, a foam rope 54 and caulking material 56 may be utilized for sealing and heat transfer purposes between each of the composite building panels 2.

Figure 16:
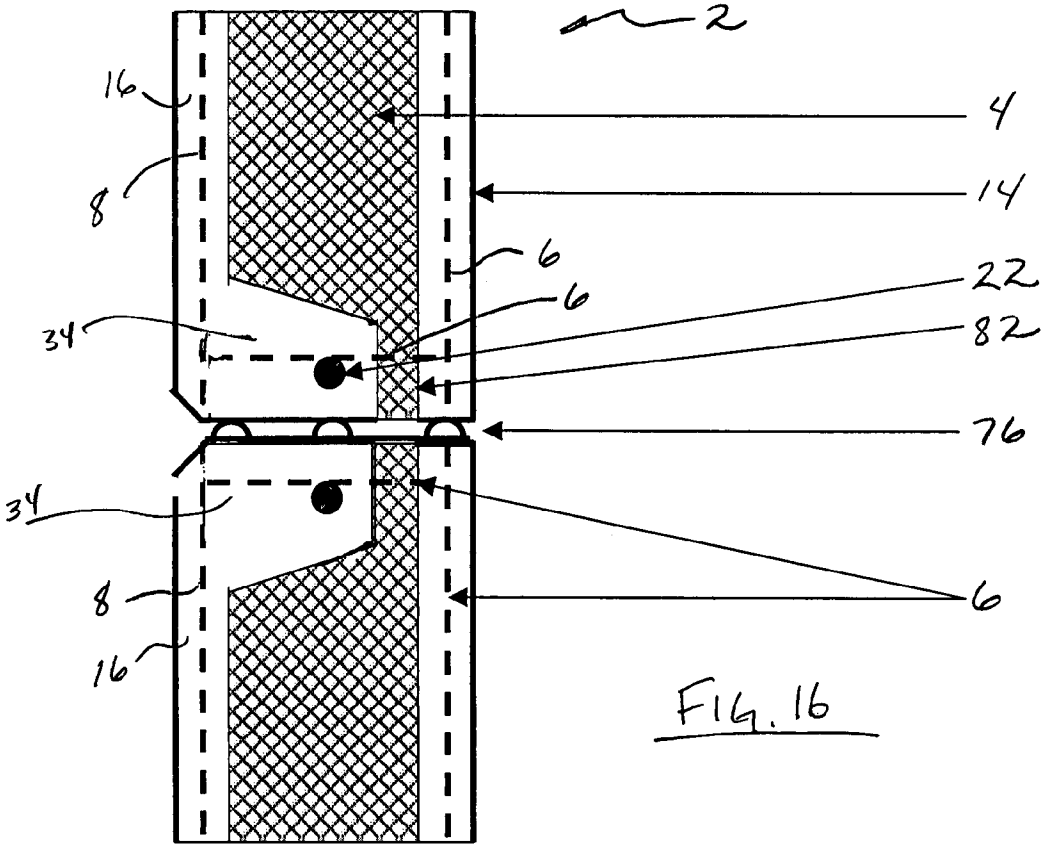
FIG. 16 is a cross-sectional front elevation view showing one composite building panel operably positioned above a second composite building panel.

Referring now to FIG. 16, a cross-sectional front elevation view showing one composite building panel operably positioned below a second composite building panel 2 is provided herein. More specifically, a compressible gasket seal 76 is positioned between the first composite building panel 2 and a second composite building panel positioned vertically on top of the first composite building panel 2. At the location where the composite building panels 2 are stacked, a insulative core cut-out portion 34 is provided, which includes one or more interior carbon fiber grid 6 which are interconnected to an exterior carbon fiber grid 8, and which are embedded in concrete along with either prestressed cable 22 or steel 5 reinforcing bars 24. By utilizing an insulative core 4 and interior and exterior carbon fiber grids, 6 and 8, respectively, it has been found that the composite building panels 2 of the present invention may be stacked vertically for lengths up to about 40 to 60 feet in an economical and safe manner.

Figure 17:
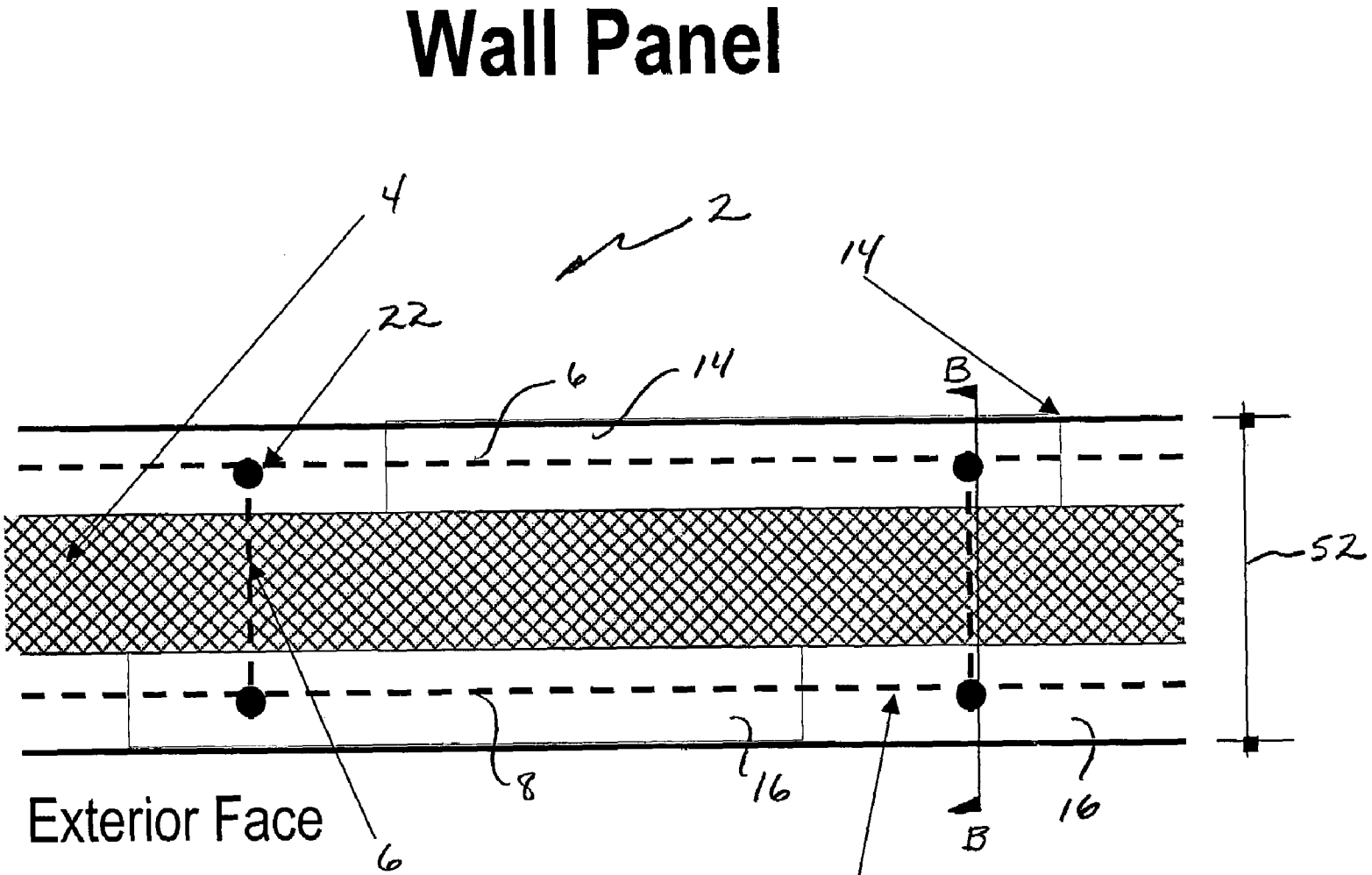
FIG. 17 is a cross-sectional top plan view of a composite building panel used in one embodiment to support a vertical load.

Referring now to FIG. 17, a cross-sectional top plan view of a composite building 10 wall panel 2 used in one embodiment to support a vertical load is provided herein. As shown in this embodiment, both the exterior carbon fiber grids 8 and interior carbon fiber grids 6 are positioned within a exterior concrete layer 16 and into concrete layer 14, respectively, and which are interconnected with either prestressed cable 22 and another layer of interior carbon fiber grid 6 material. By providing the additional structural integrity with the interior and exterior carbon fiber grids, it has been found that the wall panels may be used to vertically support other panel walls, or can be load bearing to support trusses and other structural frame work.

Figure 18:
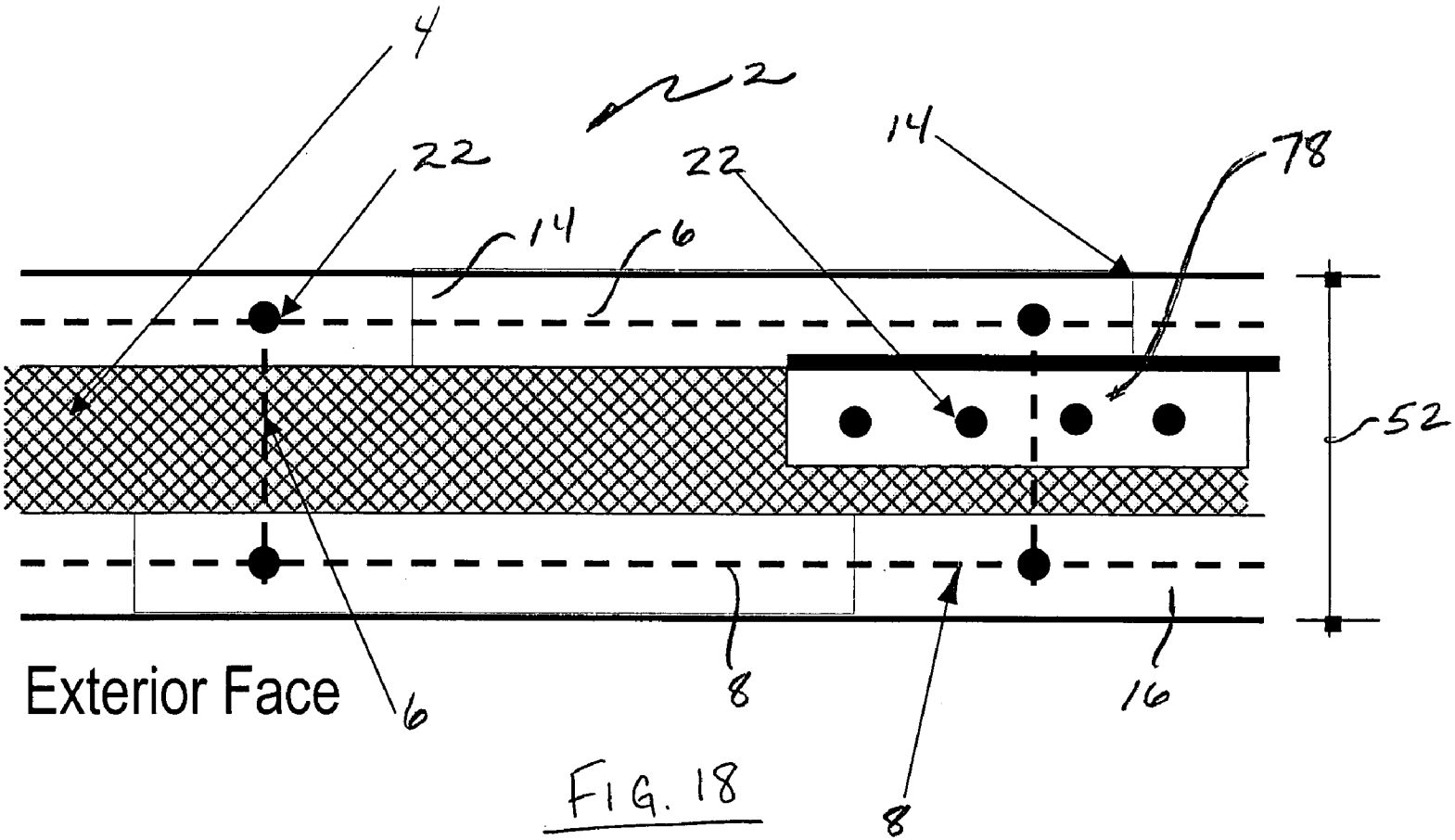
FIG. 18 is a cross-sectional top plan view of a load bearing composite wall building panel with a reinforced pilaster portion.

Referring now to FIG. 18, a cross-sectional top plan view of a load bearing composite wall building panel 12 with a reinforced "pilaster" portion 78 is provided herein. More specifically, the insulative core cut-out portion 34 comprises a plurality of prestressed cable 22, or alternatively reinforcing bars 24, and are used in combination with an interior carbon fiber grid 6 and interior concrete layers 14 to provide a reinforced load bearing panel wall which is capable of compressive structural loads of at least about 3500 psi.

Figure 19:
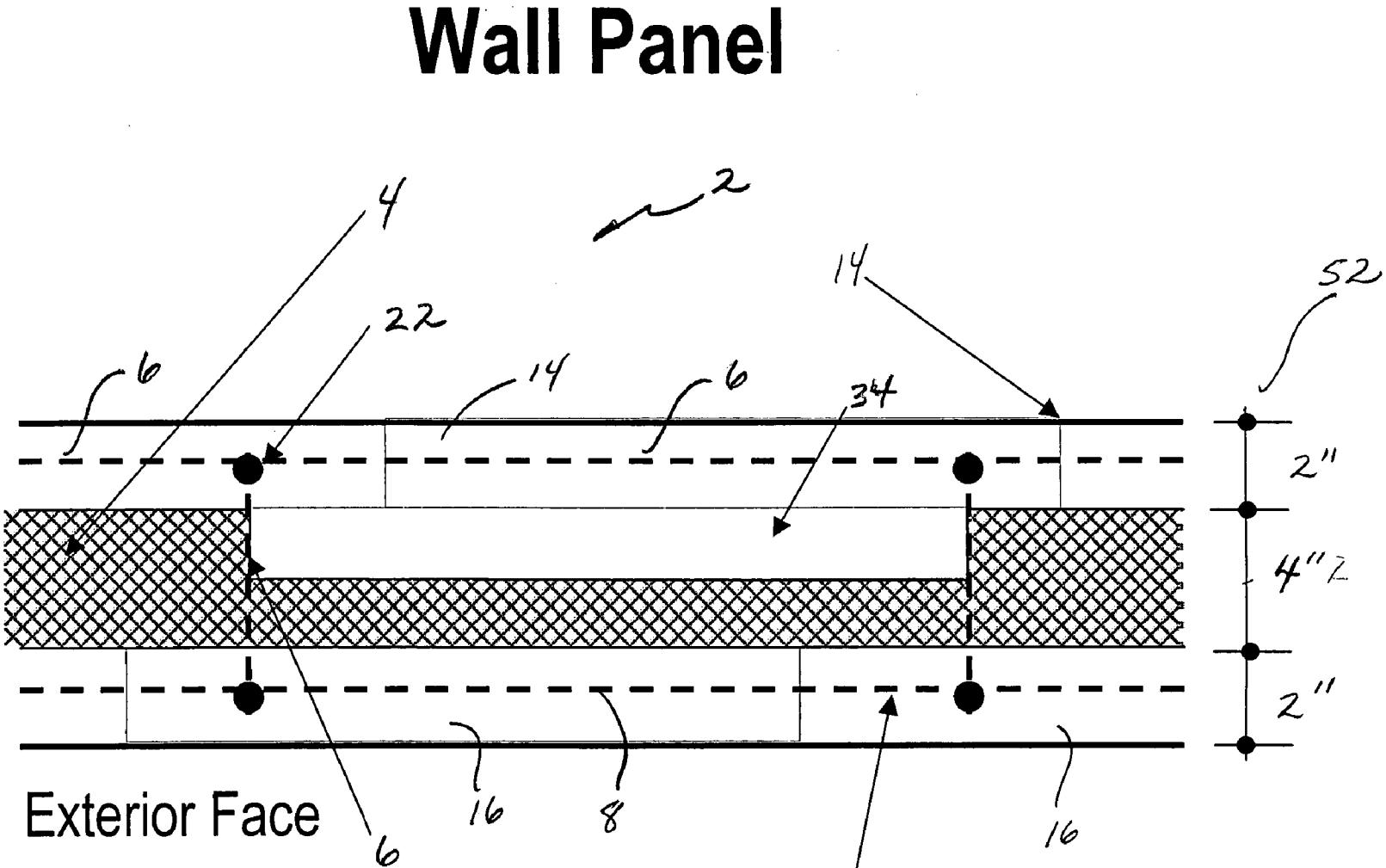
FIG. 19 is a cross-sectional top plan view of an alternative composite wall panel.

Referring now to FIG. 19, a cross-sectional of plan view of an alternative composite wall panel 2 is provided herein, and which further identifies a insulative core cut-out 34 which is used in combination with prestressed cable 22, and interior carbon fiber grid 6 and exterior carbon fiber grid 8. The carbon fiber grids are further embedded in an exterior concrete layer 16, an interior concrete layer 14, and which provide a strong wall panel for numerous construction applications. As further depicted in this drawing, the wall panel 2 has a width of about 6 inches, which includes a 2 inch layer of exterior concrete 16, a 2 inch layer of interior concrete 14, and a 4 inch layer of insulation core 4.

Figure 20:
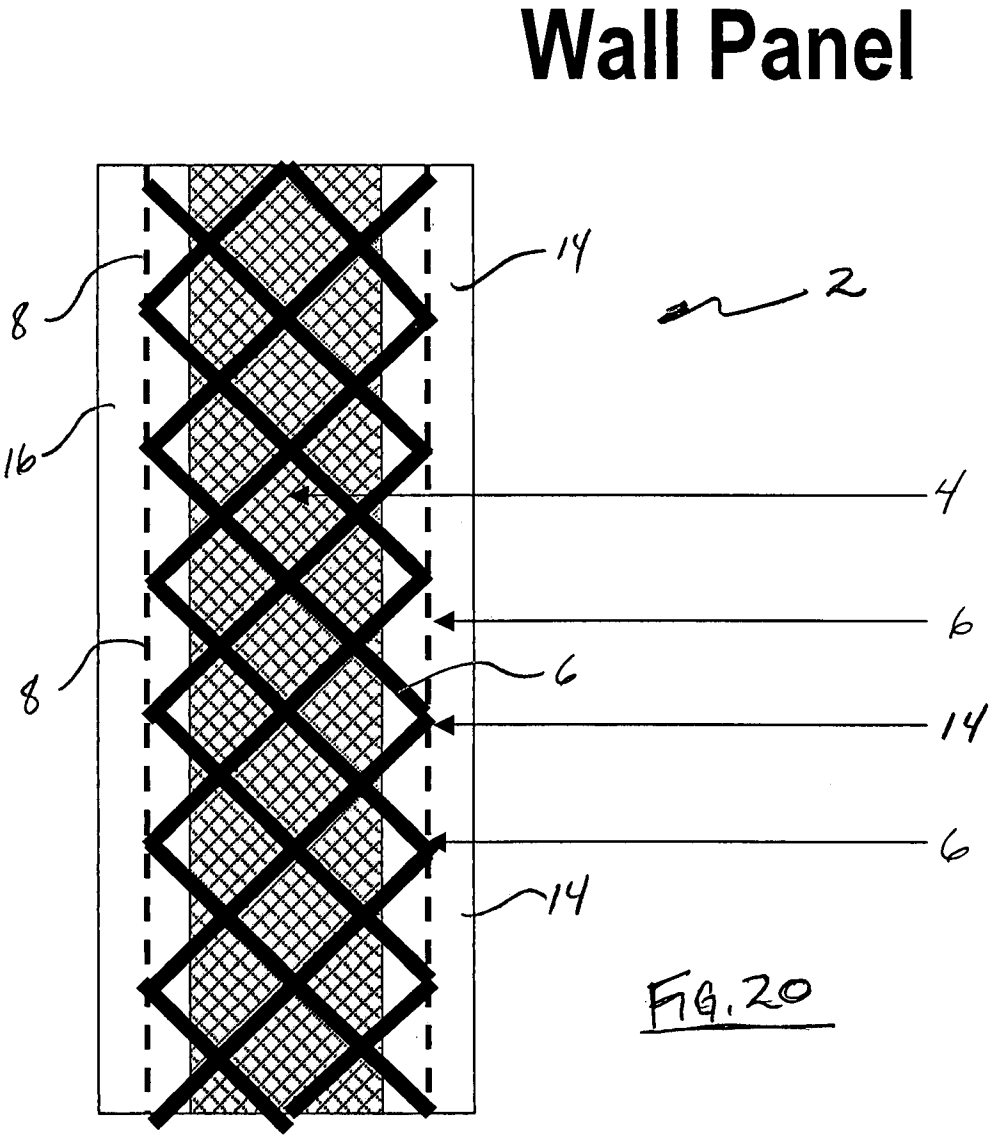
FIG. 20 is a cross-sectional front elevation view depicting the carbon fiber grid and other internal components taken at section BB of FIG. 17.

Referring now to FIG. 20, a cross-sectional front elevation view depicting the carbon fiber grid and other internal components taken at section BB of FIG. 17 is provided herein. More specifically, the interior carbon fiber grid 6 is shown extending substantially between an exterior concrete layer 16 to an interior concrete layer 14, and further interconnected to a exterior carbon fiber grid 8 and an interior carbon fiber grid 6. By utilizing these materials in combination with the lightweight insulated core 4, a lightweight, structurally reinforced wall panel can be constructed and transported in a cost effective manner.

Figure 21:
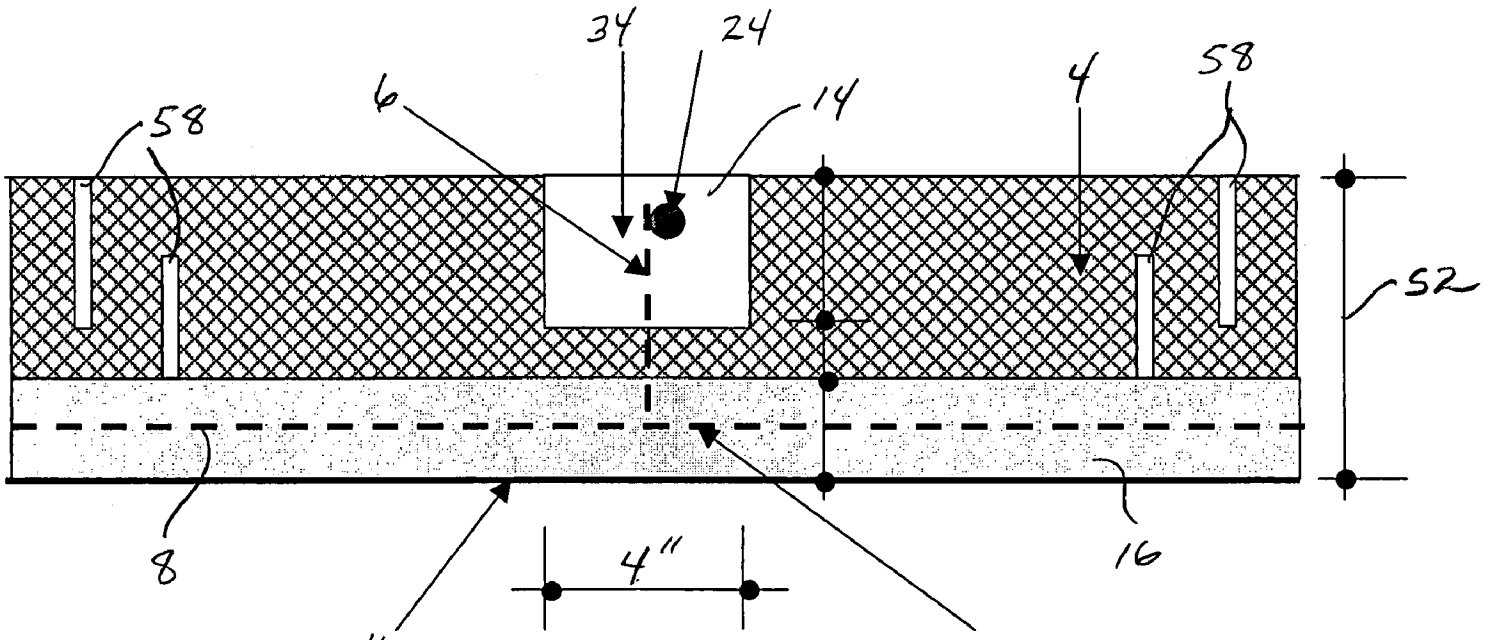
FIG. 21 is a cross-sectional top plan view showing a residential composite wall panel with a substantially square shaped cut out portion.

Referring now to FIG. 21, a cross-sectional top plan view is provided which depicts a multi-unit residential wall panel, and depicting a middle rib cut-out 34 provided herein.

More specifically, the insulative cut-out 34 in this embodiment includes a substantially square shaped cut-out portion 34 which includes a interior concrete layer 14, a interior is carbon fiber grid 6, and one or more reinforcing bars 24 or pre-stressed cable. Preferably, the width of the insulative core cut-out 34 is about 4 inches, but as appreciated by one skilled in the art may be between about 2 and 10 inches as necessary. Furthermore, a plurality of expansion joint 58 may be provided herein to help maintain the structural integrity of the interior concrete layer 14 and the exterior concrete layer 16. Furthermore, the residential wall panel shown in FIG. 21 is designed to be less load bearing than some other embodiments of the present invention, and would generally be utilized for exterior or interior wall applications.

Figure 22:
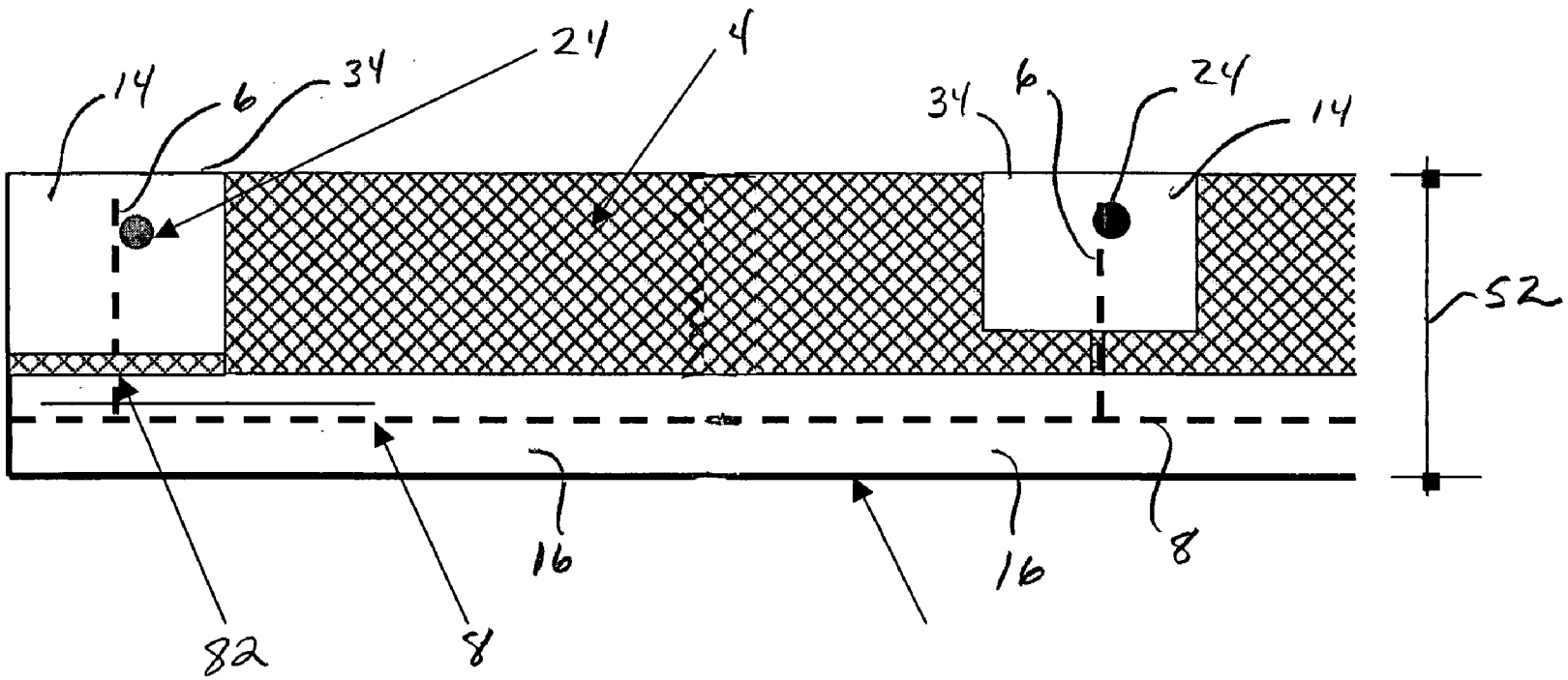
FIG. 22 is a cross-sectional top plan view of a residential composite wall panel shown at an end rib.

Referring now to FIG. 22, a cross-sectional top plan view of a residential composite wall panel shown at an rib is provided herein. More specifically, a substantially square end rib is shown adjacent to an end portion of the wall panel 2, and which includes an interior carbon fiber grid 6, at least one reinforcing bar 24, and a small layer of an insulative core material 34 which serves as a thermal break 82 between the interior concrete layer 14 and the exterior concrete layer 16.

Figure 23:
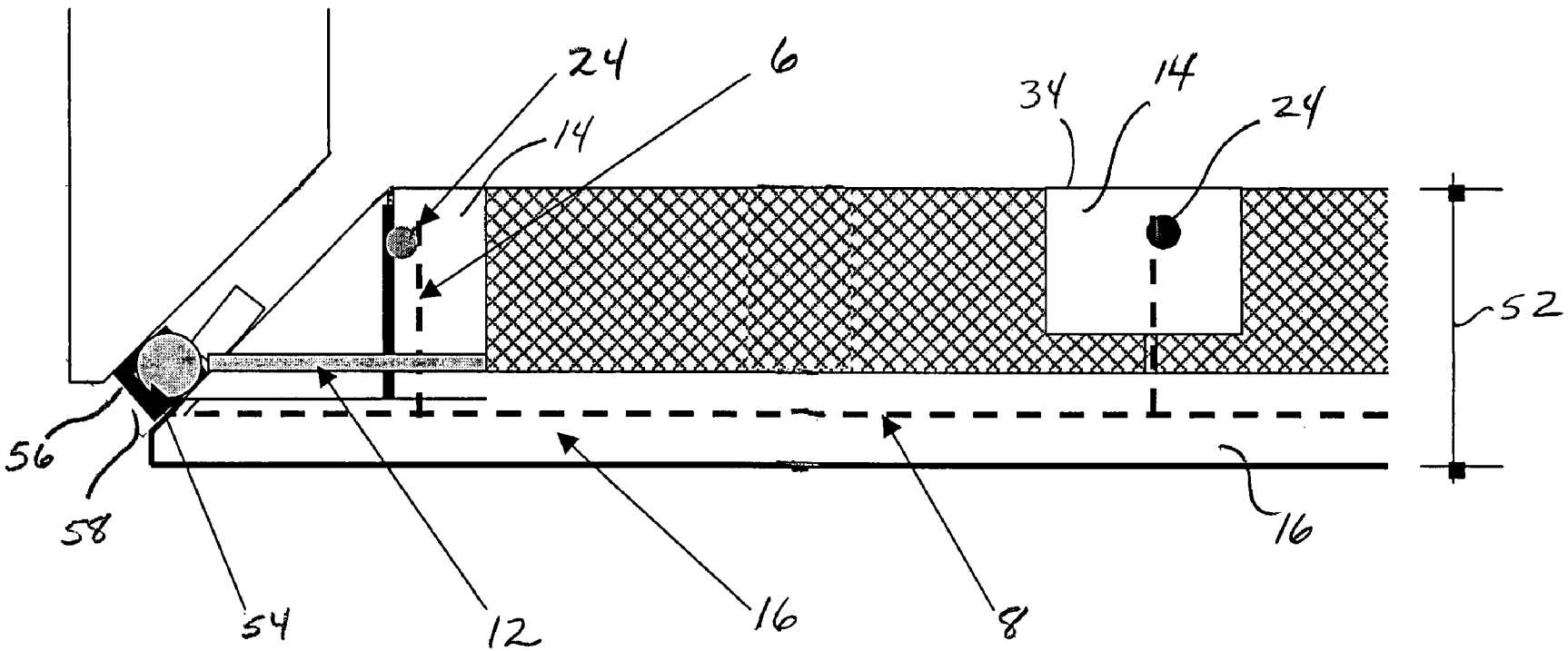
FIG. 23 is a cross-sectional top plan view of a residential composite building panel shown at a corner rib.

Referring now to FIG. 23, a cross-sectional top plan view of a residential composite building panel as shown at a corner rib is provided herein. More specifically, the interconnection of two composite building panels 2 are shown at a corner section, and which utilizes a foam rope 54 and caulking material for insulative purposes. The end sections utilize a insulative cut-out 34 which includes one or more interior carbon fiber grid 6, one or more reinforcing bars 24 or prestressed cable 22, and a thermal/vapor barrier 12. By utilizing the combination of these materials, additional structural integrity can be achieved at the corner sections between two composite building panels 2.

Figure 24:
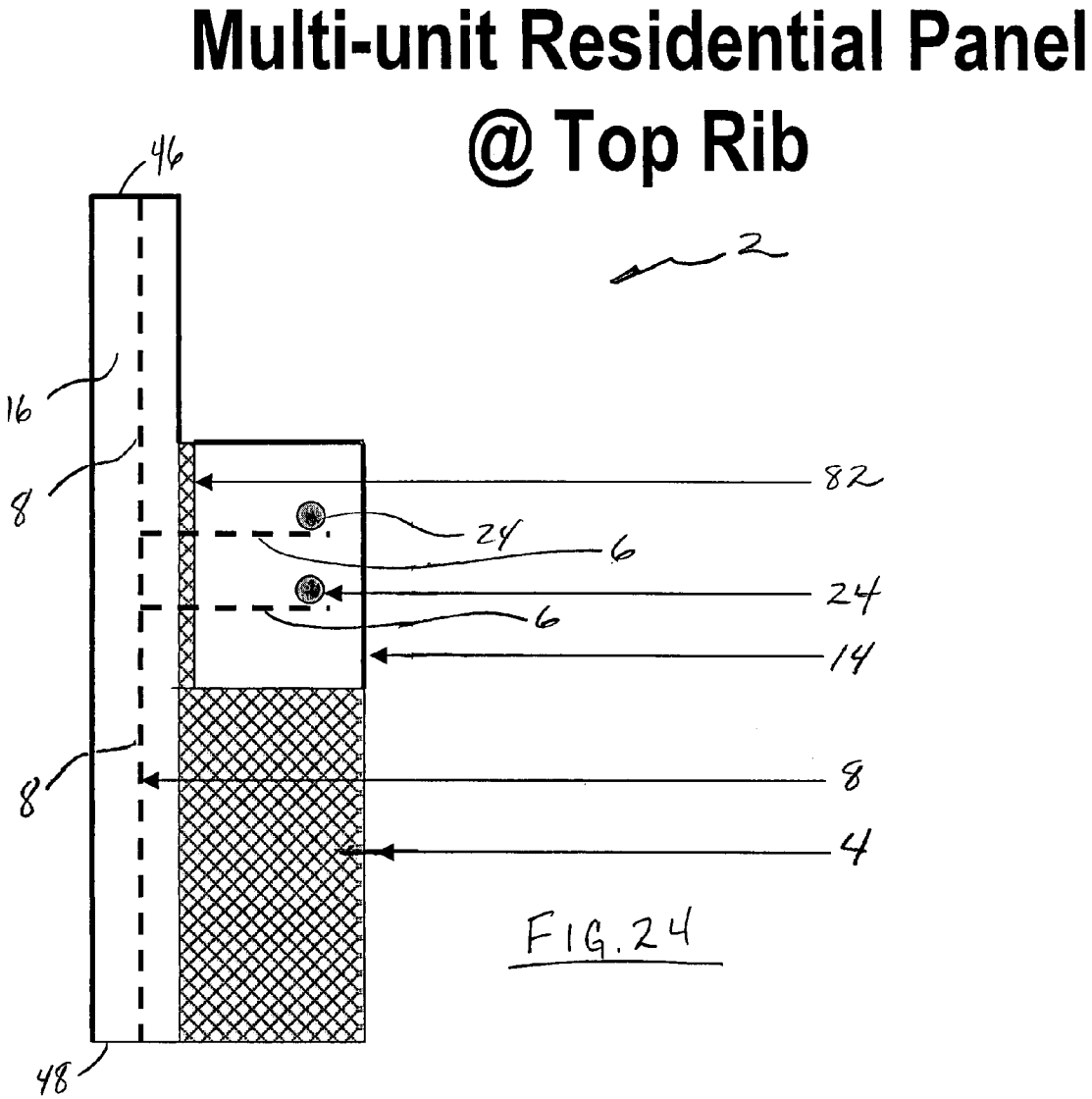
FIG. 24 is a cross-sectional front elevation view of a residential composite building panel shown at a top rib.

Referring now to FIG. 24, a cross-sectional front elevation view of a residential composite building panel shown at a top rib is provided herein. More specifically, the insulative core cut-out portion 34 includes one or more reinforcing bars 24 and a plurality of interior carbon fiber grids 6 which are interconnected to an exterior carbon fiber grid 8. As further depicted in FIG. 24, a thermal break 82 is provided with a one to two inch layer of insulated core material 4, and which is positioned between the exterior concrete layer 16 and the interior concrete layer 14. The notch created from the top of the building panel upper end 36 and the upper portion of the insulative core cut-out 34 may be utilized to support structural beams, floor joists or other structural members comprised of wood, concrete, steel or other well known materials used in residential or commercial construction.

Figure 25:
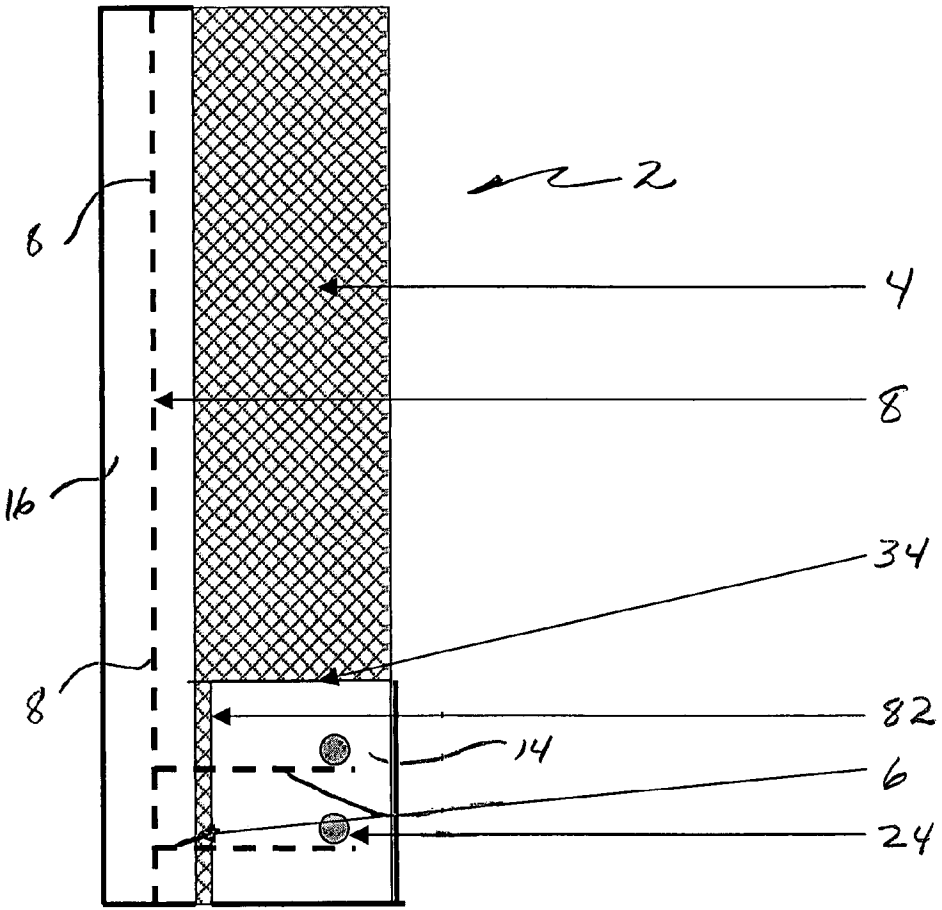
FIG. 25 is a cross-sectional front elevation view of a residential composite building panel shown at a bottom rib.

Referring now to FIG. 25, a cross-sectional front elevation view of a residential composite building panel shown at a bottom rib is provided herein. More specifically, the bottom rib comprises a insulative core cutout 34 which utilizes one or more reinforcing bars 24 or prestressed cables 22, and which are positioned within an interior concrete layer 14 and extending outwardly toward an exterior face and into an exterior concrete layer 16. As further shown, the exterior concrete layer 16 further comprises an exterior carbon fiber grid 8. By utilizing the insulative core cut-out 34 and other structural components described herein, structural integrity and strength is provided to the bottom rib of the residential panel, and which is capable of withstanding the loading requirements necessary in a residential wall panel and capable of compressive strengths of at least about 3500 psi.

In many of the embodiment of the present invention, the insulative core 4 is manufactured in a unique process with a plurality of carbon fibers strands 10 positioned in a ribbon/tape pattern 30 which extends through the insulative core 4 and which protrudes beyond both the interior and exterior surfaces to accommodate interconnection to the interior and exterior carbon fiber grids. Alternatively, metallic materials such as wire and mesh comprised of steel or other similar materials may also be used as appreciated by one skilled in the art.

A depiction of one embodiment of the carbon fiber strands 10 and their orientation and interconnection may be seen in FIG. 12. These carbon fiber strands 10 generally have a thickness of between about 0.05 inches to 0.4 inch, and more preferably a diameter of about 0.15 inches. As more typically referred to in the art, the carbon fiber strands 10 have a given "tow" size. The tow is the number of carbon strands, and may be in the example between about 12,000–48,000 individual strands, i.e., 12K to 48K tow. The intersection points of the carbon fiber strands which are required to make the tape pattern are interconnected with a strong resin such as a thermoset which is applied under a predetermined heat and pressure. In another embodiment, the individual strands of carbon fiber may be "woven" with other strands to create a stronger ribbon/tape material 30.

The carbon fiber strands 10 are interconnected to the interior carbon fiber grid 6 positioned substantially adjacent to the interior surface of the insulative core and with the exterior carbon fiber grid 8 positioned substantially adjacent the exterior surface of the insulative core 4. One example of a carbon fiber grid ribbon 30 which may be used in the present invention is the "MeC-GRID™" carbon fiber material which is manufactured by Hexcel Clark-Schwebel. The interior and exterior carbon grid tape is comprised generally of looped or crossed weft and warped strands, that run substantially perpendicular to each other and are machine placed on several main tape "stabilizing strands" that run parallel to the running/rolling direction of the tape. The carbon fiber tape is then used in a totally separate process by casting it transversely through the insulating core 4, to produce an insulated structural core panel that links together compositively the interior concrete layer 14 and exterior concrete layer 16 of the composite wall panel 2.

With regard to the concrete utilized in various embodiments of the present application, the interior wall may be comprised of a low density concrete such as Cret-o-Lite™, which is manufactured by Advanced Materials Company of Hamburg, N.Y. This is an air dried cellular concrete which is nailable, drillable, screwable, sawable and very fire resistant. In a preferred embodiment, the exterior concrete layer 16 is comprised of a dense concrete material to resist moisture penetration and in one embodiment is created using VISCO CRETE™ or equal product which is a chemical that enables the high slumped short pot life liquification of concrete to enable the concrete to be placed in narrow wall cavities with minimum vibration and thus create a high density substantially impermeable concrete layer. VISCO-CRETE™ is manufactured by the Sika Corporation, located in Lyndhurst, N.J. The exterior concrete layer 16 is preferably about ¾ to 2 inches thick, and more preferably about 1.25 inches thick. This concrete layer has a compression strength of approximately 5000 psi after 28 days of curing, and is thus extremely weather resistant.

In a preferred embodiment of the present invention, a vapor barrier material 12 may be positioned next to or on to the exterior surface of the insulative core 4, or alternatively on the interior surface of the insulative foam core 4. The vapor barrier 12 impedes the penetration of moisture and thus protects the foam core from harsh environmental conditions caused by temperature changes. Preferably, the vapor barrier 12 is comprised of a plastic sheet material, or other substantially impermeable materials that may be applied to the insulative core 4 during manufacturing of the foam core, or alternatively applied after manufacturing and prior to the pouring of the exterior concrete layer 16.

Positioned proximate to the carbon fiber sheer strip 30 is one or more reinforcing bar 36, which are generally "rebar" materials manufactured from carbon steel or other similar metallic materials. Preferably, the reinforcing bar 36 has a diameter of at least about 0.5 inches, and more preferably about 0.75–1.00 inches. As appreciated by one skilled in the art, the reinforcing bars 36 may be any variety of dimensions or lengths depending on the length and width of the building panel 2, and the strength requirements necessary for any given project. As additionally seen in FIG. 11, a third reinforcing bar 36 may additionally be positioned proximate to the wire mesh 38 adjacent the building panel interior surface 14 to provide additional strength and durability.

To assist in the understanding of the present invention, the following is a list of the components identified in the drawings and the numbering associated therewith:

| # | Component |
|---|---|
| 2 | Composite building panel |
| 4 | Insulative core |
| 6 | Interior carbon fiber grid |
| 8 | Exterior carbon fiber grid |
| 10 | Carbon fiber strands |
| 12 | Thermal/vapor barrier |
| 14 | Interior concrete layer |
| 16 | Exterior concrete layer |
| 18 | Utility conduit |
| 20 | Exterior cladding |
| 22 | Pre-stressed cable |
| 24 | Reinforcing bar |
| 26 | Wire mesh |
| 28 | Lifting anchor |
| 30 | Reinforced window/door frame |
| 32 | Lifting anchor reinforcing mesh material |
| 34 | Insulative core cut-out |
| 36 | Insulative core inner surface |
| 38 | Insulative core outer surface |
| 40 | Insulative core upper end |
| 42 | Insulative core lower end |
| 44 | Weep tube |
| 46 | Building panel upper end |
| 48 | Building panel lower end |
| 50 | Fabrication form |
| 52 | Panel thickness |
| 54 | Foam rope |
| 56 | Caulking |
| 58 | Expansion joint |
| 60 | Steel structural column |
| 62 | Bearing angle with gussets |
| 64 | Slotted lateral connector hardware |

-continued

| # | Component |
|---|---|
| 66 | Mineral wool board |
| 68 | Concrete floor slab |
| 70 | Unistrut channel with posts |
| 72 | Column clip |
| 74 | Threaded fastener |
| 76 | Compressible gasketlseal |
| 78 | Pilaster |
| 80 | Interconnection stud |
| 82 | Thermal Break |

The foregoing description of the present invention has been presented for purposes of illustration and description. Furthermore, the description is not intended to limit the invention to the form disclosed herein. Consequently, variations and modifications commenced here with the above teachings and the skill or knowledge of the relevant art are within the scope in the present invention. The embodiments described herein above are further extended to explain best modes known for practicing the invention and to enable others skilled in the art to utilize the invention in such, or other, embodiments or various modifications required by the particular applications or uses of present invention. It is intended that the dependent claims be construed to include all possible embodiments to the extent permitted by the prior art.

What is claimed is:

1. A low density, substantially planar carbon fiber reinforced concrete building panel having an upper end, a lower end, and a substantially longitudinal axis defined between said upper end and said lower end, comprising:

an insulative core having an inner surface, an outer surface, an upper end, a lower end, and a plurality of perimeter edges, said foam core comprising at least one cut-out portion extending substantially between at least two of said plurality of perimeter edges;

a first concrete material positioned adjacent said outer surface of said core;

a first carbon fiber material positioned within said first concrete material;

a second carbon fiber material positioned within said at least one cut-out portion of said core and extending through said core beyond said outer surface and in operable contact with said first carbon fiber material;

second first reinforcing bar positioned proximate to said at least one carbon fiber material within said cut-out portion, and extending substantially between said upper end and said lower end of said core; and a second concrete material positioned within said cut-out portion of said core, and extending substantially from said upper end to a lower end of said core.

2. The low density, carbon fiber reinforced concrete building panel of claim 1, wherein said first carbon fiber material comprises at least one carbon fiber shear strip comprised of an interwoven grid of individual carbon fibers.

3. The carbon fiber reinforced concrete building panel of claim 1, wherein said core is comprised of at least one of an expanded polystyrene, an extruded polystyrene, an extruded polypropylene and a polyisocyanurate.

4. The carbon fiber reinforced concrete building panel of claim 1, wherein said at least one cut-out portion has a substantially triangular shape with an apex oriented toward said outer surface of said building panel.

5. The carbon fiber reinforced concrete building panel of claim 1, further comprising a second reinforcing bar positioned proximate to at least one of a plurality of perimeter edges of said concrete building panel.

6. The carbon fiber reinforced concrete building panel of claim 1, further comprising a third carbon fiber material positioned along a plurality of perimeter edges of said building panel to provide additional strength to said building panel.

7. The carbon fiber reinforced concrete building panel of claim 1, wherein said at least one first reinforcing bar is comprised of a metallic rod having a diameter of at least about 0.25 inches.

8. The carbon fiber reinforced concrete building panel of claim 1, further comprising a third reinforcing bar which is positioned proximate to at least one of a plurality of perimeter edges of said substantially planar concrete panel.

9. The carbon fiber reinforced concrete building panel of claim 1, further comprising at least one of a window frame and a door frame positioned between said upper end and said lower end of said building panel and extending between said outer surface and said inner surface.

10. The carbon fiber reinforced concrete building panel of claim 1, further comprising a vapor barrier material positioned proximate to at least one of an interior surface and an exterior surface of said core.

11. The carbon fiber reinforced concrete building panel of claim 1, further comprising a weep tube positioned proximate to said core, wherein moisture is operatively drained from said building panel.

12. The carbon fiber reinforced concrete building panel of claim 1, further comprising a stud positioned within said at least one cut-out portion, and extending beyond an inner surface of said core, said stud including at least one aperture to receive at least one of a conduit, a communications cable, a planar pipe and an electrical wire.

13. The building panel of claim 12, wherein said stud is comprised of at least one of a metal, a fiberglass, a plastic, and a wood material.

14. The building panel of claim 1, further comprising a cladding material interconnected to said first concrete material.

15. A reinforced concrete building panel having an interior surface, an exterior surface, an upper end, a lower end, and lateral edges extending therebetween comprising:

a first concrete layer;

a first reinforcing grid positioned within said first concrete layer;

a core having an interior surface, an exterior surface, an upper end and a lower end and lateral edges positioned therebetween, said exterior surface in contact with said first concrete layer;

at least one cut-out portion positioned within said core, said cut-out portion including a second reinforcing grid which extends through said core and into said first concrete layer;

a second concrete layer positioned within said cut-out portion; and at least one reinforcing rod positioned proximate to said second reinforcing grid.

16. The reinforced concrete building panel of claim 15, wherein said at least one reinforcing rod is comprised of at least one of a metallic material.

17. The reinforced concrete building panel of claim 15, wherein said core is comprised of at least one of an expanded polystyrene material, an extruded polystyrene material, an extruded polypropylene and a polyisocyanurate material.

18. The reinforced concrete building panel of claim 15, wherein said first reinforcing grid and said second reinforcing grid are comprised of at least one of a carbon fiber material, a wire mesh material and a fiberglass material.

19. The reinforced concrete building panel of claim 15, wherein said first reinforcing grid is operably interconnected to said second reinforcing grid and at least one of said first concrete layer and said second concrete layer.

20. The reinforced concrete building panel of claim 15, further comprising a third reinforcing grid positioned proximate to at least one of a plurality of perimeter edges for increased structural strength.

21. The reinforced concrete building panel of claim 15, wherein said at least one cut-out portion has at least one of a substantially triangular and a substantially rectangular cross-sectional shape.

22. The reinforced concrete building panel of claim 15, wherein said at least one reinforcing rod is operably interconnected to said second reinforcing grid.

23. The reinforced concrete building panel of claim 15, further comprising an interior cladding material interconnected to said interior surface of said foam core.

24. The reinforced concrete building panel of claim 15, further comprising at least one of a window frame and a door frame positioned within said reinforced concrete building panel.

25. The reinforced concrete building panel of claim 15, wherein said reinforced concrete building panel has a density of no greater than about 33 pounds per square foot.

26. The reinforced concrete building panel of claim 15, further comprising a third reinforcing bar positioned along at least one perimeter edge of said reinforced concrete building panel.

27. The reinforced concrete building panel of claim 15, wherein said core is comprised of a plurality of individual panels.

28. The reinforced concrete building panel of claim 15, further comprising a plurality of spacers interconnected to said reinforcing rod to provide separation between said reinforcing rod and said foam core.

29. The reinforced concrete building panel of claim 15, wherein said at least one reinforcing rod is under tension.

30. The reinforced concrete building panel of claim 15, further comprising a thermal barrier material positioned proximate to at least said lateral edges to inhibit heat transfer in said concrete building panel.

* * * * *